US011164541B2

(12) United States Patent
Holland et al.

(10) Patent No.: US 11,164,541 B2
(45) Date of Patent: Nov. 2, 2021

(54) MULTI-FRAME BURN-IN STATISTICS GATHERING

(71) Applicant: Apple Inc., Cupertino, CA (US)

(72) Inventors: Peter F. Holland, Los Gatos, CA (US); Mahesh B. Chappalli, San Jose, CA (US)

(73) Assignee: Apple, Inc., Cupertino, CA (US)

( * ) Notice: Subject to any disclaimer, the term of this patent is extended or adjusted under 35 U.S.C. 154(b) by 0 days.

(21) Appl. No.: 16/711,322

(22) Filed: Dec. 11, 2019

(65) Prior Publication Data

US 2021/0183334 A1 Jun. 17, 2021

(51) Int. Cl.
*G09G 3/16* (2006.01)
*G09G 5/10* (2006.01)

(52) U.S. Cl.
CPC ..... *G09G 5/10* (2013.01); *G09G 2320/029* (2013.01); *G09G 2320/046* (2013.01)

(58) Field of Classification Search
CPC ..... G09G 2320/046; G09G 2320/048; G09G 2320/0285; G09G 2320/043; G09G 2320/0233; G09G 2360/16; G09G 2320/0626; G09G 3/3225; G09G 2320/045; G09G 2320/0242; G09G 3/3406; G09G 3/3648
See application file for complete search history.

(56) References Cited

U.S. PATENT DOCUMENTS 7,742,032 B2 6/2010 Diefenbaugh et al.
8,077,123 B2 12/2011 Naugler, Jr.
8,194,063 B2 6/2012 Levey et al.
9,230,478 B2 1/2016 Byeon et al.
9,430,968 B2 8/2016 Noritaka et al.
9,997,104 B2 6/2018 Zhang et al.
10,049,614 B2 8/2018 Peana et al.
10,163,388 B2 12/2018 Zhang et al.
10,198,991 B2 2/2019 Lindberg et al.
2001/0035850 A1 11/2001 Okamoto et al.
(Continued)

FOREIGN PATENT DOCUMENTS

CN 105247603 A 1/2016

OTHER PUBLICATIONS

Extended European Search Report for EP 18189845.3 dated Jan. 25, 2019, pp. 1-16.
(Continued)

*Primary Examiner* — Hau H Nguyen
(74) *Attorney, Agent, or Firm* — Fletcher Yoder P.C.

(57) ABSTRACT

An electronic device may include an electronic display to display images during frames based on image data. The electronic display may be divided into multiple regions each having multiple pixels. The electronic device may also include a display pipeline to process the image data and output the processed image data to the electronic display. The display pipeline may also determine a history update corresponding to an estimated burn-in aging effect of the pixels based on usage. A first portion of the history update corresponding to pixels in a first region may be determined during a first frame and a second portion of the history update corresponding to pixels in a second region may be determined during a second frame.

22 Claims, 14 Drawing Sheets

(56) References Cited

U.S. PATENT DOCUMENTS

| | | | | |
|---|---|---|---|---|
| 2006/0221186 | A1* | 10/2006 | Lin | H04N 7/0122 348/173 |
| 2007/0146385 | A1 | 6/2007 | Kienhoefer | |
| 2007/0236410 | A1* | 10/2007 | Shimizu | H04N 3/20 345/20 |
| 2008/0055210 | A1 | 3/2008 | Cok | |
| 2008/0284702 | A1 | 11/2008 | Shidara et al. | |
| 2009/0147032 | A1 | 6/2009 | Kim | |
| 2013/0321361 | A1 | 12/2013 | Lynch et al. | |
| 2014/0176403 | A1 | 6/2014 | Inoue et al. | |
| 2015/0243216 | A1 | 8/2015 | Chung et al. | |
| 2016/0267834 | A1 | 9/2016 | Zheng et al. | |
| 2016/0314760 | A1 | 10/2016 | Jangda et al. | |
| 2016/0335965 | A1 | 11/2016 | Huang et al. | |
| 2017/0213493 | A1 | 7/2017 | Han | |
| 2018/0151132 | A1 | 5/2018 | Lee et al. | |
| 2018/0350289 | A1 | 12/2018 | Drzaio et al. | |
| 2018/0350290 | A1 | 12/2018 | Drzaic et al. | |
| 2018/0350295 | A1 | 12/2018 | Drzaic et al. | |
| 2018/0350296 | A1 | 12/2018 | Thompson et al. | |
| 2019/0080666 | A1 | 3/2019 | Chappalli et al. | |

OTHER PUBLICATIONS

Office Action for KR 10-2018-0098518 dated Jul. 16, 2019, pp. 1-14.
Office Action for JP 2018-162477 dated Sep. 30, 2019, pp. 1-5.
Chinese Office Action for Chinese Application No. 201811006622.X dated Jun. 1, 2021; 13 pgs.
Chinese Office Action for Chinese Application No. 201780056143.6 dated Jun. 22, 2021; 16 pgs.

* cited by examiner

MULTI-FRAME BURN-IN STATISTICS GATHERING

BACKGROUND

This disclosure relates to image data processing to identify and compensate for burn-in on an electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Numerous electronic devices—including televisions, portable phones, computers, wearable devices, vehicle dashboards, virtual-reality glasses, and more—display images on an electronic display. As electronic displays gain increasingly higher resolutions and dynamic ranges, they may also become increasingly more susceptible to image display artifacts due to pixel burn-in. Burn-in is a phenomenon whereby pixels degrade over time owing to the different amount of light that different pixels emit over time. In other words, pixels may age at different rates depending on their relative utilization. For example, pixels used more than others may age more quickly, and thus may gradually emit less light when given the same amount of driving current or voltage values. This may produce undesirable burn-in image artifacts on the electronic display.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure relates to identifying and compensating for burn-in and/or aging artifacts on an electronic display. Burn-in is a phenomenon whereby pixels degrade over time owing to various factors, including the different amounts of light that different pixels may emit over time. For example, if certain pixels are used more frequently than others, or used in situations that are more likely cause undue aging, such as high temperature environments, those pixels may exhibit more aging than other pixels. As a result, those pixels may gradually emit less light when given the same driving current or voltage values, effectively becoming darker than the other pixels when given a signal for the same brightness level. As such, without compensation, burn-in artifacts may be visibly perceived due to non-uniform sub-pixel aging. To prevent this sub-pixel aging effect from causing undesirable image artifacts on the electronic display, circuitry and/or software may monitor and/or model the amount of burn-in that is likely to have occurred in the different pixels. Based on the monitored and/or modeled amount of burn-in that is determined to have occurred, the image data may be adjusted before it is sent to the electronic display to reduce or eliminate the appearance of burn-in artifacts on the electronic display.

In one example, circuitry and/or software may monitor or model a burn-in effect that would be likely to occur in the electronic display as a result of the image data that is sent to the electronic display. Additionally or alternatively, the circuitry and/or software may monitor and/or model a burn-in effect that would be likely to occur in the electronic display as a result of the temperature of different parts of the electronic display while the electronic display is operating. For instance, a pixel may age more rapidly by emitting a larger amount of light at a higher temperature and may age more slowly by emitting a smaller amount of light at a lower temperature.

By monitoring and/or modeling the amount of burn-in that has likely taken place in the electronic display, burn-in gain maps may be derived to compensate for the burn-in effects. Namely, the burn-in gain maps may gain down image data that will be sent to the less-aged pixels (which would otherwise appear brighter) without gaining down the image data that will be sent to the pixels with the greatest amount of aging (which would otherwise appear darker). In this way, the pixels of the electronic display that have suffered the greatest amount of aging will appear to be equally as bright as the pixels that have suffered the least amount of aging. As such, perceivable burn-in artifacts on the electronic display may be reduced or eliminated.

In some embodiments, the gain applied to the image data may be determined based on aging relationships between gray level, the average luminance output of the display, and/or the emission duty cycle of each pixel from previously obtained burn-in statistics and/or the current frame to be displayed. The emission duty cycle may be indicative of pulse-width modulation of the emission pulse used for a pixel to obtain a desired brightness. For example, below a threshold brightness, the voltage may be held constant, and the emission pulse-width modulated at a particular duty cycle to obtain darker luminance levels. Moreover, the effect of burn-in on a pixel may differ at different emission duty cycles. Additionally, in some embodiments, the emission duty cycle may change the burn-in aging rate of the pixel and/or the output luminance of the pixel.

Furthermore, the collection of burn-in statistics may be based on the gray level, the emission duty cycle of each pixel, the global brightness of the display, and/or the average brightness of the display. In some embodiments, the burn-in statistics may be downsampled for storage and/or computational efficiency. For example, the burn-in statistics may utilize a dynamic string (e.g., a string of 8 bits) that has a different interpretation depending on the emission duty cycle of the pixel. For example, the write out of the burn-in statistics to memory may represent different levels of burn-in for each pixel depending on the emission duty cycle of each pixel.

Additionally or alternatively, the burn-in statistics may be gathered on all of the display pixels, or a subset of the display pixels, depending on the active region. Moreover, the pixels within the active region may be split into multiple vertical segments and burn-in statistics may be gathered on each vertical segment during different periods of time to reduce the overall statistics gathered while maintaining comprehensive burn-in statistics for the display.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

By monitoring and/or modeling an amount of burn-in that has likely taken place in the electronic display, burn-in gain maps may be derived to compensate for the burn-in effects. The burn-in gain maps may gain down image data that will be sent to the less-aged pixels (which would otherwise be brighter) without gaining down, or by gaining down less, the image data that will be sent to the pixels with the greatest amount of aging (which would otherwise be darker). In this way, the pixels of the electronic display that are likely to exhibit the greatest amount of aging will appear to be equally as bright as pixels with less aging. In this manner, perceivable burn-in artifacts on the electronic display may be reduced or eliminated.

Figure 1:
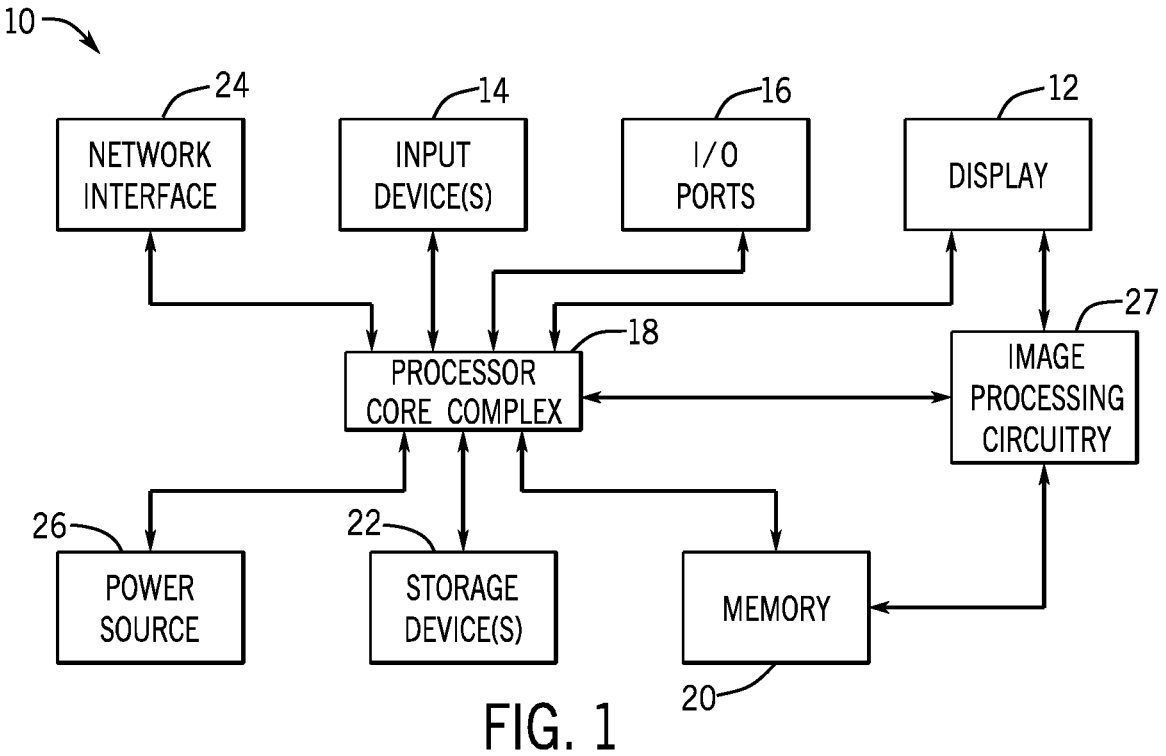
FIG. 1 is a block diagram of an electronic device including an electronic display, in accordance with an embodiment.

To help illustrate, one embodiment of an electronic device 10 that utilizes an electronic display 12 is shown in FIG. 1. As will be described in more detail below, the electronic device 10 may be any suitable electronic device, such as a handheld electronic device, a tablet electronic device, a notebook computer, and the like. Thus, it should be noted that FIG. 1 is merely one example of a particular implementation and is intended to illustrate the types of components that may be present in the electronic device 10.

In the depicted embodiment, the electronic device 10 includes the electronic display 12, input devices 14, input/output (I/O) ports 16, a processor core complex 18 having one or more processors or processor cores, local memory 20, a main memory storage device 22, a network interface 24, a power source 26, and image processing circuitry 27. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the local memory 20 and the main memory storage device 22 may be included in a single component. Additionally, the image processing circuitry 27 (e.g., a graphics processing unit, a display image processing pipeline) may be included in the processor core complex 18.

As depicted, the processor core complex 18 is operably coupled with local memory 20 and the main memory storage device 22. In some embodiments, the local memory 20 and/or the main memory storage device 22 may include tangible, non-transitory, computer-readable media that store instructions executable by the processor core complex 18 and/or data to be processed by the processor core complex 18. For example, the local memory 20 may include random access memory (RAM) and the main memory storage device 22 may include read only memory (ROM), rewritable non-volatile memory such as flash memory, hard drives, optical discs, and/or the like.

In some embodiments, the processor core complex 18 may execute instructions stored in local memory 20 and/or the main memory storage device 22 to perform operations, such as generating source image data. As such, the processor core complex 18 may include one or more general purpose microprocessors, one or more application specific processors (ASICs), one or more field programmable logic arrays (FPGAs), or any combination thereof.

As depicted, the processor core complex 18 is also operably coupled with the network interface 24. Using the network interface 24, the electronic device 10 may be communicatively coupled to a network and/or other electronic devices. For example, the network interface 24 may connect the electronic device 10 to a personal area network (PAN), such as a Bluetooth network, a local area network (LAN), such as an 802.11x Wi-Fi network, and/or a wide area network (WAN), such as a 4G or LTE cellular network. In this manner, the network interface 24 may enable the electronic device 10 to transmit image data to a network and/or receive image data from the network.

Additionally, as depicted, the processor core complex 18 is operably coupled to the power source 26. In some embodiments, the power source 26 may provide electrical power to operate the processor core complex 18 and/or other components in the electronic device 10. Thus, the power source 26 may include any suitable source of energy, such as a rechargeable lithium polymer (Li-poly) battery and/or an alternating current (AC) power converter.

Furthermore, as depicted, the processor core complex 18 is operably coupled with the I/O ports 16 and the input devices 14. In some embodiments, the I/O ports 16 may enable the electronic device 10 to interface with various other electronic devices. Additionally, in some embodiments, the input devices 14 may enable a user to interact with the electronic device 10. For example, the input devices 14 may include buttons, keyboards, mice, trackpads, and the like. Additionally or alternatively, the electronic display 12 may include touch sensing components that enable user inputs to the electronic device 10 by detecting occurrence and/or position of an object touching its screen (e.g., surface of the electronic display 12).

In addition to enabling user inputs, the electronic display 12 may facilitate providing visual representations of information by displaying one or more images (e.g., image frames or pictures). For example, the electronic display 12 may display a graphical user interface (GUI) of an operating system, an application interface, text, a still image, or video content. To facilitate displaying images, the electronic display 12 may include a display panel with one or more display pixels. Additionally, each display pixel may include one or more sub-pixels, which each control luminance of one color component (e.g., red, blue, or green).

As described above, the electronic display 12 may display an image by controlling luminance of the sub-pixels based at least in part on corresponding image data (e.g., image pixel image data and/or display pixel image data). In some embodiments, the image data may be received from another electronic device, for example, via the network interface 24 and/or the I/O ports 16. Additionally or alternatively, the image data may be generated by the processor core complex 18 and/or the image processing circuitry 27.

Figure 2:
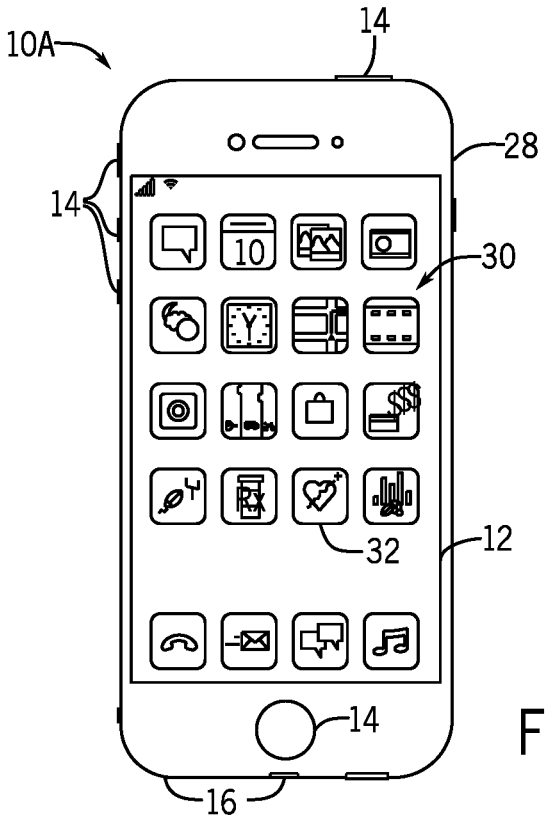
FIG. 2 is an example of the electronic device of FIG. 1, in accordance with an embodiment.

As described above, the electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For example, the handheld device 10A may be a smart phone, such as any iPhone® model available from Apple Inc.

As depicted, the handheld device 10A includes an enclosure 28 (e.g., housing). In some embodiments, the enclosure 28 may protect interior components from physical damage and/or shield them from electromagnetic interference. Additionally, as depicted, the enclosure 28 surrounds the electronic display 12. In the depicted embodiment, the electronic display 12 is displaying a graphical user interface (GUI) 30 having an array of icons 32. By way of example, when an icon 32 is selected either by an input device 14 or a touch-sensing component of the electronic display 12, an application program may launch.

Furthermore, as depicted, input devices 14 open through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. As depicted, the I/O ports 16 also open through the enclosure 28. In some embodiments, the I/O ports 16 may include, for example, an audio jack to connect to external devices.

Figure 3:
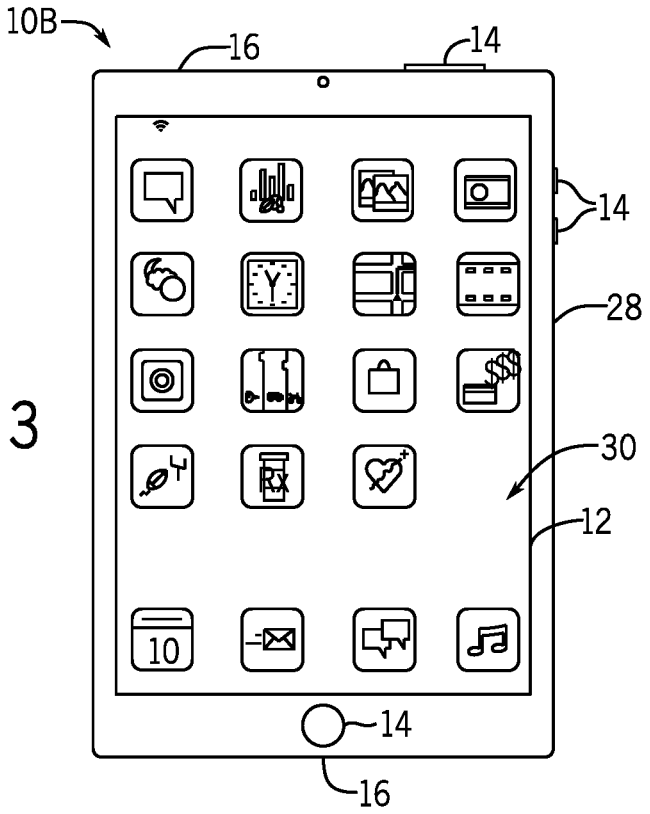
FIG. 3 is another example of the electronic device of FIG. 1, in accordance with an embodiment.
Figure 4:
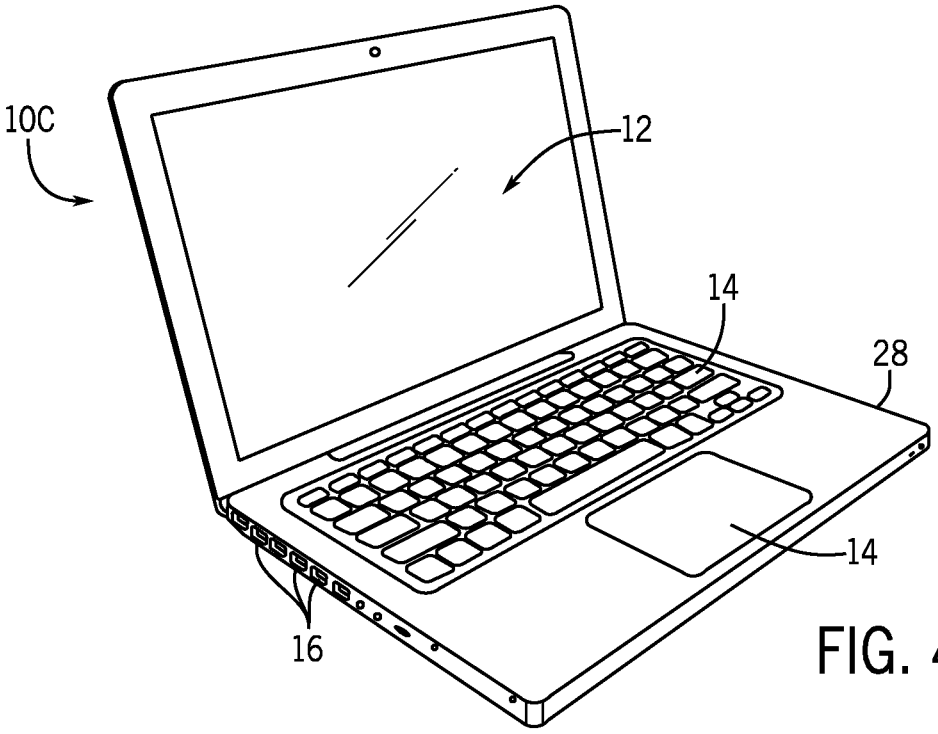
FIG. 4 is another example of the electronic device of FIG. 1, in accordance with an embodiment.
Figure 5:
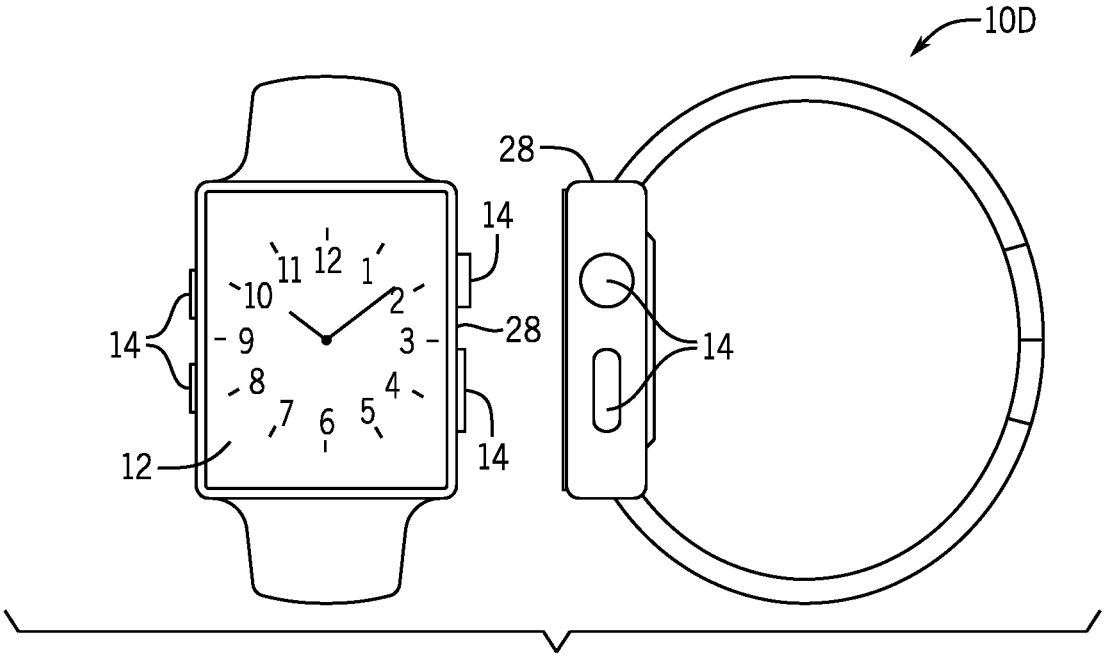
FIG. 5 is another example of the electronic device of FIG. 1, in accordance with an embodiment.

To further illustrate, another example of a suitable electronic device 10, specifically a tablet device 10B, is shown in FIG. 3. For illustrative purposes, the tablet device 10B may be any iPad® model available from Apple Inc. A further example of a suitable electronic device 10, specifically a computer 10C, is shown in FIG. 4. For illustrative purposes, the computer 10C may be any MacBook® or iMac® model available from Apple Inc. Another example of a suitable electronic device 10, specifically a watch 10D, is shown in FIG. 5. For illustrative purposes, the watch 10D may be any Apple Watch® model available from Apple Inc. As depicted, the tablet device 10B, the computer 10C, and the watch 10D each also includes an electronic display 12, input devices 14, I/O ports 16, and an enclosure 28.

As described above, the electronic display 12 may display images based at least in part on image data received, for example, from the processor core complex 18 and/or the image processing circuitry 27. Additionally, as described above, the image data may be processed before being used to display a corresponding image on the electronic display 12. In some embodiments, a display pipeline may process the image data, for example, to identify and/or compensate for burn-in and/or aging artifacts.

Figure 6:
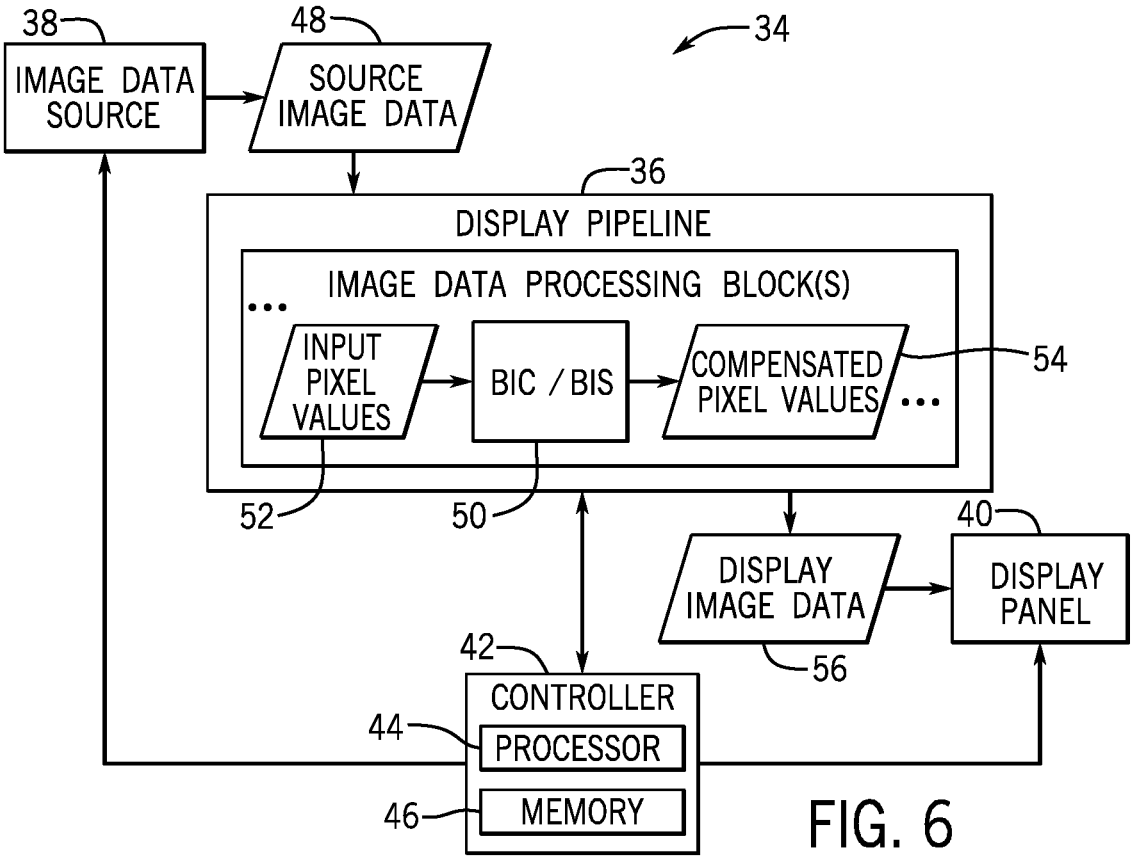
FIG. 6 is a block diagram of a portion of the electronic device of FIG. 1 including a display pipeline that has burn-in compensation (BIC) and burn-in statistics (BIS) collection circuitry, in accordance with an embodiment.

To help illustrate, a portion 34 of the electronic device 10 including a display pipeline 36 is shown in FIG. 6. In some embodiments, the display pipeline 36 may be implemented by circuitry in the electronic device 10, circuitry in the electronic display 12, or a combination thereof. For example, the display pipeline 36 may be included in the processor core complex 18, the image processing circuitry 27, a timing controller (TCON) in the electronic display 12, or any combination thereof.

As depicted, the portion 34 of the electronic device 10 also includes an image data source 38, a display panel 40, and a controller 42. In some embodiments, the display panel 40 of the electronic display 12 may be a liquid crystal display (LCD), a light emitting diode (LED) display, an organic LED (OLED) display, or any other suitable type of display panel 40. In some embodiments, the controller 42 may control operation of the display pipeline 36, the image data source 38, and/or the display panel 40. To facilitate controlling operation, the controller 42 may include a controller processor 44 and/or controller memory 46. In some embodiments, the controller processor 44 may be included in the processor core complex 18, the image processing circuitry 27, a timing controller in the electronic display 12, a separate processing module, or any combination thereof and execute instructions stored in the controller memory 46. Additionally, in some embodiments, the controller memory 46 may be included in the local memory 20, the main memory storage device 22, a separate tangible, non-transitory, computer readable medium, or any combination thereof.

In the depicted embodiment, the display pipeline 36 is communicatively coupled to the image data source 38. In this manner, the display pipeline 36 may receive source image data 48 corresponding with an image to be displayed on the electronic display 12 from the image data source 38. The source image data 48 may indicate target characteristics (e.g., pixel data) corresponding to a desired image using any suitable source format, such as an 8-bit fixed point αRGB format, a 10-bit fixed point αRGB format, a signed 16-bit floating point αRGB format, an 8-bit fixed point YCbCr format, a 10-bit fixed point YCbCr format, a 12-bit fixed point YCbCr format, and/or the like. In some embodiments, the image data source 38 may be included in the processor core complex 18, the image processing circuitry 27, or a combination thereof. Furthermore, the source image data 48 may reside in a linear color space, a gamma-corrected color space, or any other suitable color space. As used herein, pixels or pixel data may refer to a grouping of sub-pixels (e.g., individual color component pixels such as red, green, and blue) or the sub-pixels themselves.

As described above, the display pipeline 36 may operate to process source image data 48 received from the image data source 38. The display pipeline 36 may include one or more image data processing blocks (e.g., circuitry, modules, or processing stages) such as the burn-in compensation (BIC)/burn-in statistics (BIS) block 50. As should be appreciated, multiple other image data processing blocks may also be incorporated into the display pipeline 36, such as a color management block, a dither block, etc. Further, the functions (e.g., operations) performed by the display pipeline 36 may be divided between various image data processing blocks, and while the term "block" is used herein, there may or may not be a logical separation between the image data processing blocks.

The BIC/BIS block 50 may compensate for burn-in to reduce or eliminate the visual effects of burn-in, as well as to collect image statistics about the degree to which burn-in is expected to have occurred on the electronic display 12. As such, the BIC/BIS block 50 may receive input pixel values 52 representative of each of the color components of source image data 48 and output compensated pixel values 54. As stated above, other image data processing blocks may also be utilized in the display pipeline 36. As such, the input pixel values 52 and/or the compensated pixel values 54 may be processed by other image data processing blocks before and/or after the BIC/BIS block 50. Moreover, the resulting display image data 56 output by the display pipeline 36 for display on the display panel 40 may suffer substantially fewer or no burn-in artifacts.

After processing, the display pipeline 36 may output the display image data 56 to the display panel 40. Based at least in part on the display image data 56, the display panel 40 may apply analog electrical signals to the display pixels of the electronic display 12 to display one or more corresponding images. In this manner, the display pipeline 36 may facilitate providing visual representations of information on the electronic display 12.

Figure 7:
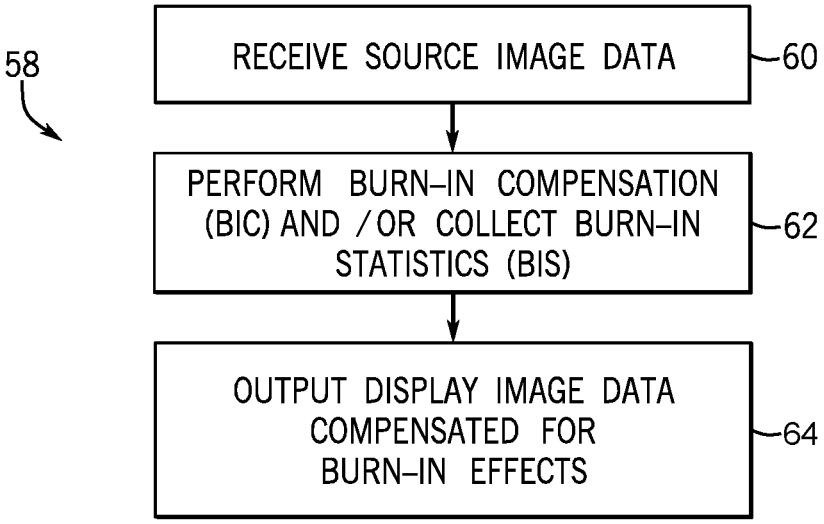
FIG. 7 is a flow diagram of a process for operating the display pipeline of FIG. 6, in accordance with an embodiment.

To help illustrate, an example of a process 58 for operating the display pipeline 36 is described in FIG. 7. Generally, the process 58 may include receiving source image data 48 from the image data source 38 or from another block of the image data processing blocks (process block 60). The display pipeline may also perform burn-in compensation (BIC) and/or collect burn-in statistics (BIS) (process block 62), for example, via the BIC/BIS block 50. The display pipeline may then output the display image data 56, which is compensated for burn-in effects (process block 64). In some embodiments, the process 58 may be implemented based on circuit connections formed in the display pipeline 36. Additionally or alternatively, in some embodiments, the process 58 may be implemented in whole or in part by executing instructions stored in a tangible non-transitory computer-readable medium, such as the controller memory 46, using processing circuitry, such as the controller processor 44.

Figure 8:
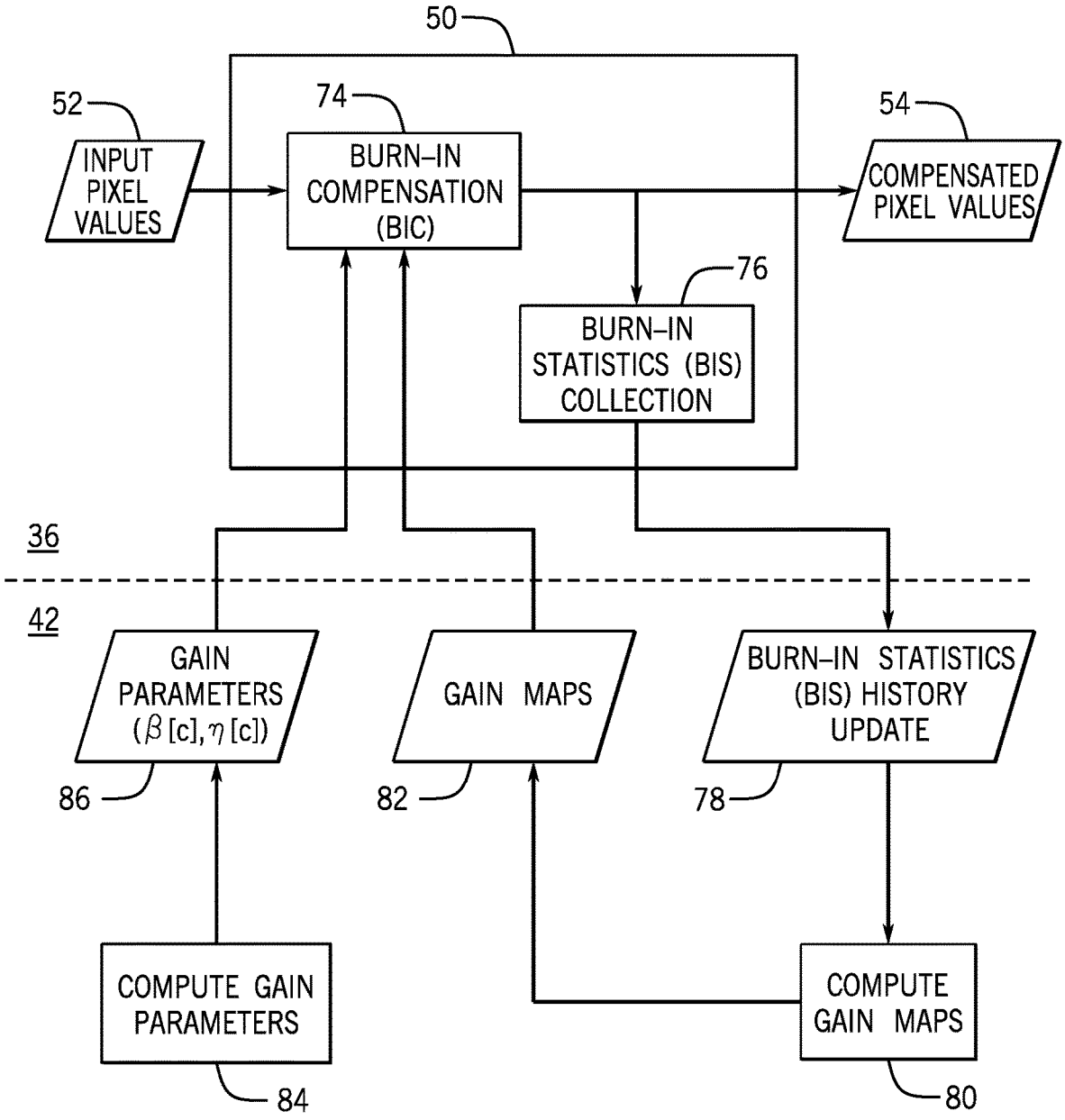
FIG. 8 is a block diagram describing burn-in compensation (BIC) and burn-in statistics (BIS) collection using the display pipeline of FIG. 6, in accordance with an embodiment.

As shown in FIG. 8, the BIC/BIS block 50 may encompass burn-in compensation (BIC) processing 74 and burn-in statistics (BIS) collection processing 76. The BIC processing 74 may receive the input pixel values 52 and output the compensated pixel values 54 adjusted for non-uniform pixel aging of the electronic display 12. Additionally, the BIS collection processing 76 may analyze all or a portion of the compensated pixel values 54 to generate a burn-in statistics (BIS) history update 78 indicative of an incremental update representing an increased amount of pixel aging that is estimated to have occurred since a corresponding previous BIS history update 78. Although the BIC processing 74 and the BIS collection processing 76 are shown as components of the display pipeline 36, the BIS history update 78 may be output for use by the controller 42 or other data processing hardware or software (e.g., an operating system, application program, or firmware of the electronic device 10). The controller 42 or other software may use the BIS history update 78 in a compute gain maps block 80 to generate gain maps 82. The gain maps 82 may be two-dimensional (2D) maps of per-color-component pixel gains. For example, the gain maps 82 may be programmed into 2D lookup tables (LUTs) in the display pipeline 36 for use by the BIC processing 74.

The controller 42 or other software (e.g., an operating system, application program, or firmware of the electronic device 10) may also include a compute gain parameters block 84 to generate gain parameters 86 that may be provided to the display pipeline 36 for use by the BIC processing 74. For example, the gain parameters 86 may include a normalization factor and a brightness adaptation factor, which may vary depending on the global display brightness, the gray level of the pixel, the emission duty cycle of the pixel, and/or the color component of image data to which the gain parameters 86 are applied (e.g., red, green, or blue), as discussed further below. As should be appreciated, the gain parameters 86 discussed herein are non-limiting, and additional parameters may also be included in determining the compensated pixel values 54 such as floating or fixed reference values and/or parameters representative of the type of electronic display panel 40. As such, the gain parameters 86 may represent any suitable parameters that the BIC processing 74 may use to appropriately adjust the values of and/or apply the gain maps 82 to compensate for burn-in.

Burn-in Compensation (BIC) Processing

Figure 9:
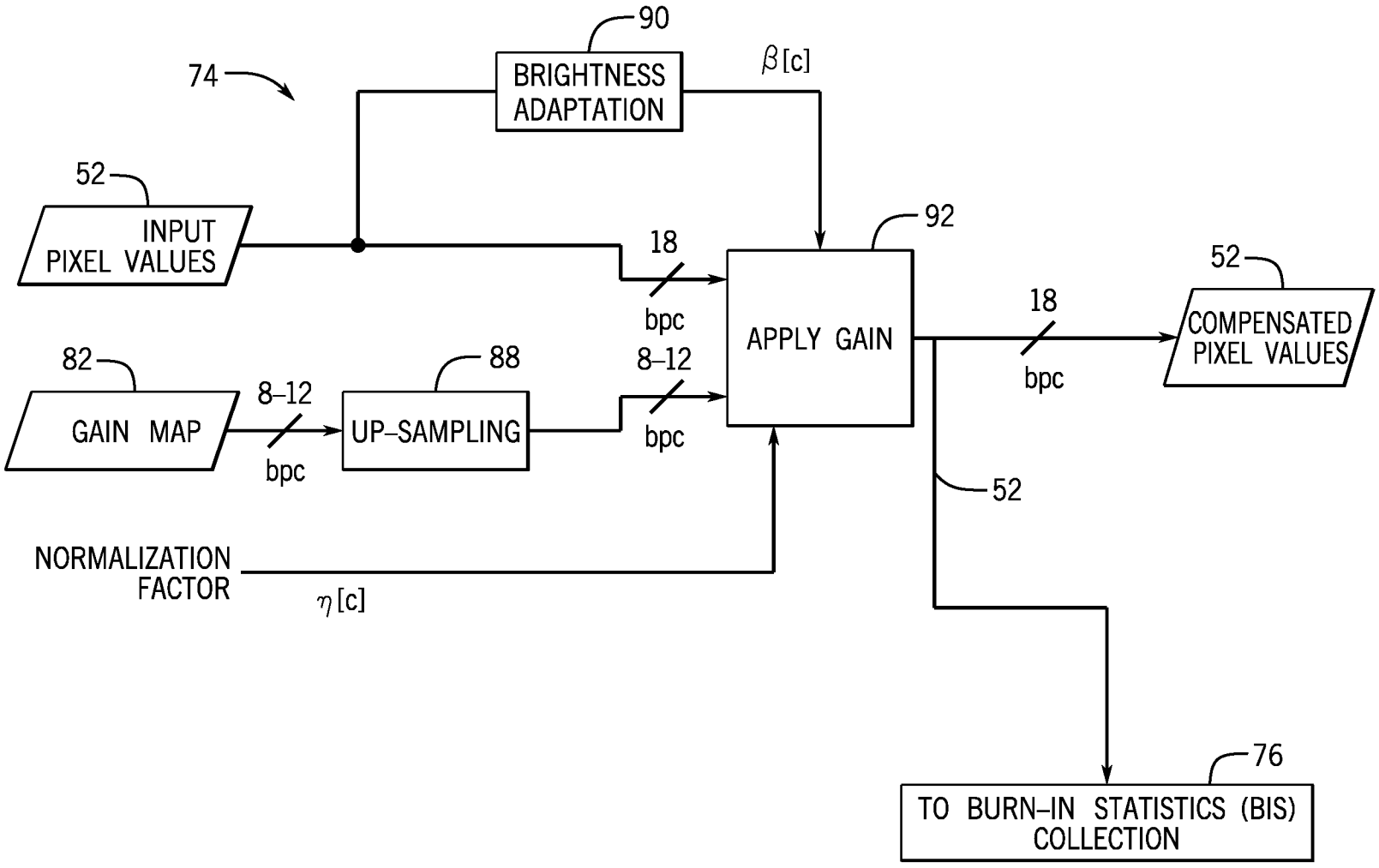
FIG. 9 is a block diagram showing burn-in compensation (BIC) using gain maps derived from the collected burn-in statistics (BIS), in accordance with an embodiment.

A closer view of the BIC processing 74 is shown in FIG. 9. The BIC processing 74 may include an up-sampling block 88, a brightness adaptation block 90, and/or an apply gain block 92. The up-sampling block 88 may receive and up-sample the gain maps 82 to spatially support the resolution of the pixel grid (e.g., the pixels of the display panel 40) and provide the per-component pixel gain value to the apply gain block 92. The brightness adaptation block 90 may receive the input pixel values 52 and generate the brightness adaptation factor based on a global brightness (e.g., an average luminance output, a total luminance output, any suitable luminance measure associated with the entire frame, and/or a brightness setting indicative of or associated with the luminance output) of the display panel 40 and/or the emission duty cycle of the individual pixels and provide it to the apply gain block 92. In some embodiments, the per-component pixel gain values may be indicative of red, green, or blue color components, for example, when the electronic display 12 has red, green, and blue colored sub-pixels, but may include other color components if the electronic display 12 has subpixels of other colors (e.g., white subpixels in an RGBW display). Furthermore, the input pixel values 52 may include location data indicative of the spatial location of the pixel on the electronic display 12.

In some embodiments, the up-sampling block 88 may allow the BIC processing 74 to use gain maps 82 that are sized to have a lower resolution than the size of the electronic display 12. For example, when the gain maps 82 have a lower resolution format, the up-sampling block 88 may up-sample values of the gain maps 82 (e.g., on a per-pixel or per-region basis). Several example operations of the up-sampling block 88 will be described further below with reference to FIGS. 11 and 12.

The pixel gain values of the gain map 82 may have any suitable format and precision. For example, the precision of the pixel gain value may be between 8 and 12 bits per component, and may vary by configuration. In one embodiment, the alignment of the most significant bit (MSb) of a pixel gain value may be configurable through a right-shift parameter, which may vary (e.g., between 0 and 7) based on implementation. For example, a right-shift parameter value of 0 may represent alignment with the first bit after the decimal point. For a right-shift parameter value of 2, the MSb of the gain value may be aligned to the fourth bit after the decimal point, effectively yielding a gain with precision between u0.11 and u0.15 precision, corresponding, for example, to a fetched value with 8 to 12 bits of precision.

The apply gain block 92 may receive input pixel values 52 for a given location on the electronic display 12, a per-component pixel gain value (e.g., derived from the gain maps 82, which may be up-sampled by the up-sampling block 88), and/or the brightness adaptation factor. The apply gain block 92 may apply the per-component pixel gain value to the input pixel values 52 for each sub-pixel according to the gain parameters 86 (e.g., the normalization factor and the brightness adaptation factor). In some embodiments, the apply gain block 92 may generate a compensation value to be applied (e.g., added or multiplied) to an input pixel value 52 to obtain a compensated pixel value 54. For example, the compensation value for a given sub-pixel may be determined based on the per-component pixel gain value from the fetched and/or up-sampled gain maps 82, the brightness adaptation factor, and/or the normalization factor. Moreover, in some embodiments, the compensation value may be proportional to the per-component pixel gain value from the fetched and/or up-sampled gain maps 82, the brightness adaptation factor, and/or the normalization factor with or without an offset such as the normalization factor. When applied, the brightness adaptation factor may, at least partially, compensate the input pixel values 52 for the emission duty cycle and/or the brightness of the current frame. Moreover, in some embodiments, the normalization factor may normalize the luminance output of the pixels with respect to one or more of the pixels with the most burn-in with respect to the maximum gain for each color component. The compensation value may be encoded in any suitable way, and, in some embodiments, may be clipped.

As stated above, the brightness adaptation factor may take any suitable form, and may take into account the global brightness setting of the electronic display 12 and/or the emission duty cycle of the pixel of interest. The emission duty cycle may be indicative of pulse-width modulation of current to the pixel to obtain a desired brightness. For example, above a threshold brightness, the brightness of the pixel may be adjusted by a voltage supplied to the pixel. However, below a threshold brightness, the voltage may be held constant, and the emission pulse-width modulated at a particular duty cycle to obtain luminance levels below the threshold brightness. The effect of burn-in on a pixel may differ at different emission duty cycles. As such, the brightness adaptation factor and/or the normalization factor may employ the emission duty cycle to assist in compensating for burn-in.

In one embodiment, the brightness adaptation block 90 may scale the input pixel values 52 by a luminance normalizer and derive the brightness adaptation factor via a lookup table (LUT) based on the scaled (e.g., via the luminance normalizer) pixel values. In some embodiments, the scaling luminance normalizer may be proportional and/or inversely proportional to the emission duty cycle of the pixel and/or the global brightness of the display panel 40 for the current frame. Moreover, in some embodiments, the luminance normalizer may be proportional to the global brightness normalized by a reference brightness. Moreover, the reference brightness, may be a fixed or floating reference value based on the luminance output of the pixels. As should be appreciated, the brightness adaptation factor may be obtained via a LUT, by computation, or any suitable method accounting for the global brightness setting of the electronic display 12 and/or the emission duty cycle of the pixel of interest.

Figure 10:
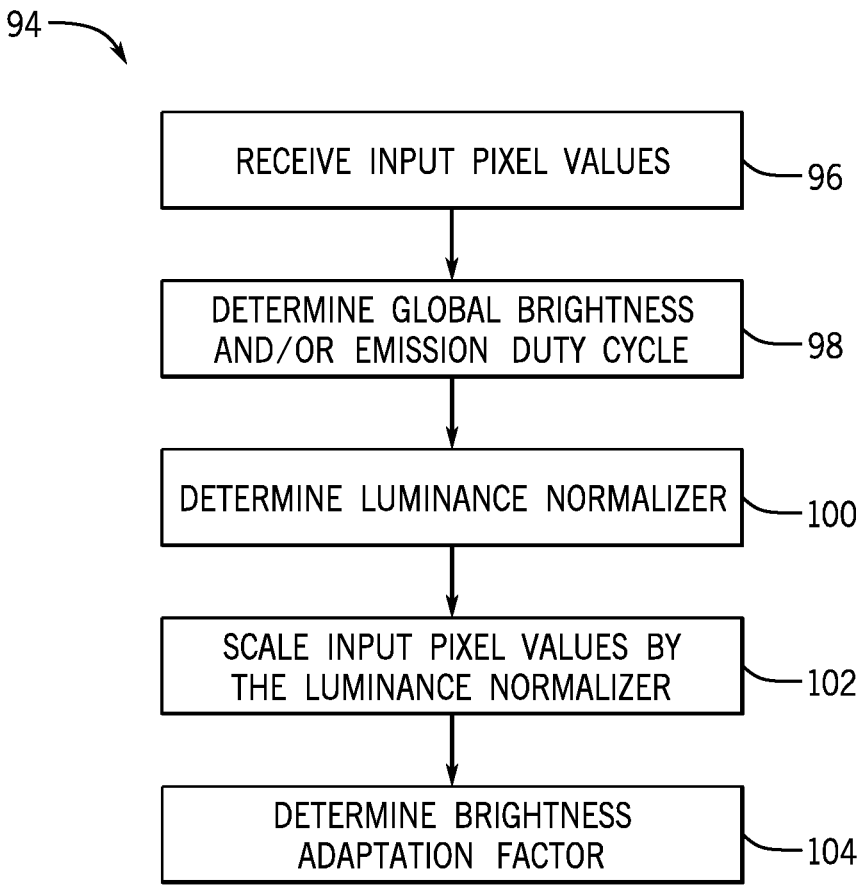
FIG. 10 is a flow diagram for determining a brightness adaptation factor, in accordance with an embodiment.

In further illustration, an example process 94 for determining the brightness adaptation factor is described in FIG. 10. The brightness adaptation block 90 may receive the input pixel values 52 for each color component of each pixel (process block 96). Additionally, the global brightness and/or emission duty cycle may be determined (process block 98). The global brightness and/or the emission duty cycle may be used to determine the luminance normalizer (process block 100). Further, the input pixel values 52 may be scaled by the luminance normalizer (process block 102), and the scaled pixel values may be used to determine the brightness adaptation factor (process block 104), for example, via a lookup table (LUT).

Additionally, in some embodiments, the normalization factor may also be a function of the luminance normalizer. The normalization factor may be calculated on a per-component basis and may take into account a maximum gain across all channels. In other words, the normalization factor may compensate for an estimated pixel burn-in of the most burnt-in pixel with respect to the maximum gain of each color component. For example, in some embodiments, the normalization factor may assign a gain of 1.0 to the pixel(s) determined to have the most burn-in and a gain of less than 1.0 to the pixel(s) that are less likely to exhibit burn-in effects.

The normalization factor may be encoded in any suitable way, and in some cases, the normalization factor may be encoded in the same format as the brightness adaptation factor. As mentioned above, the gain parameters 86 may include the normalization factor and the brightness adaptation factor. Furthermore, the gain parameters 86 may be updated and provided to the apply gain block 92 at any suitable frequency. For example, in some embodiments, the normalization factor and the brightness adaptation factor may be updated every frame or some multiple of frames and/or every time the global brightness settings change. In some scenarios, the normalization factor and/or the brightness adaptation factor may be updated less often (e.g., once every other frame, once every 5 frames, once per second, once per 2 seconds, once per 5 seconds, once per 30 seconds, once per minute, or the like).

Figure 11:
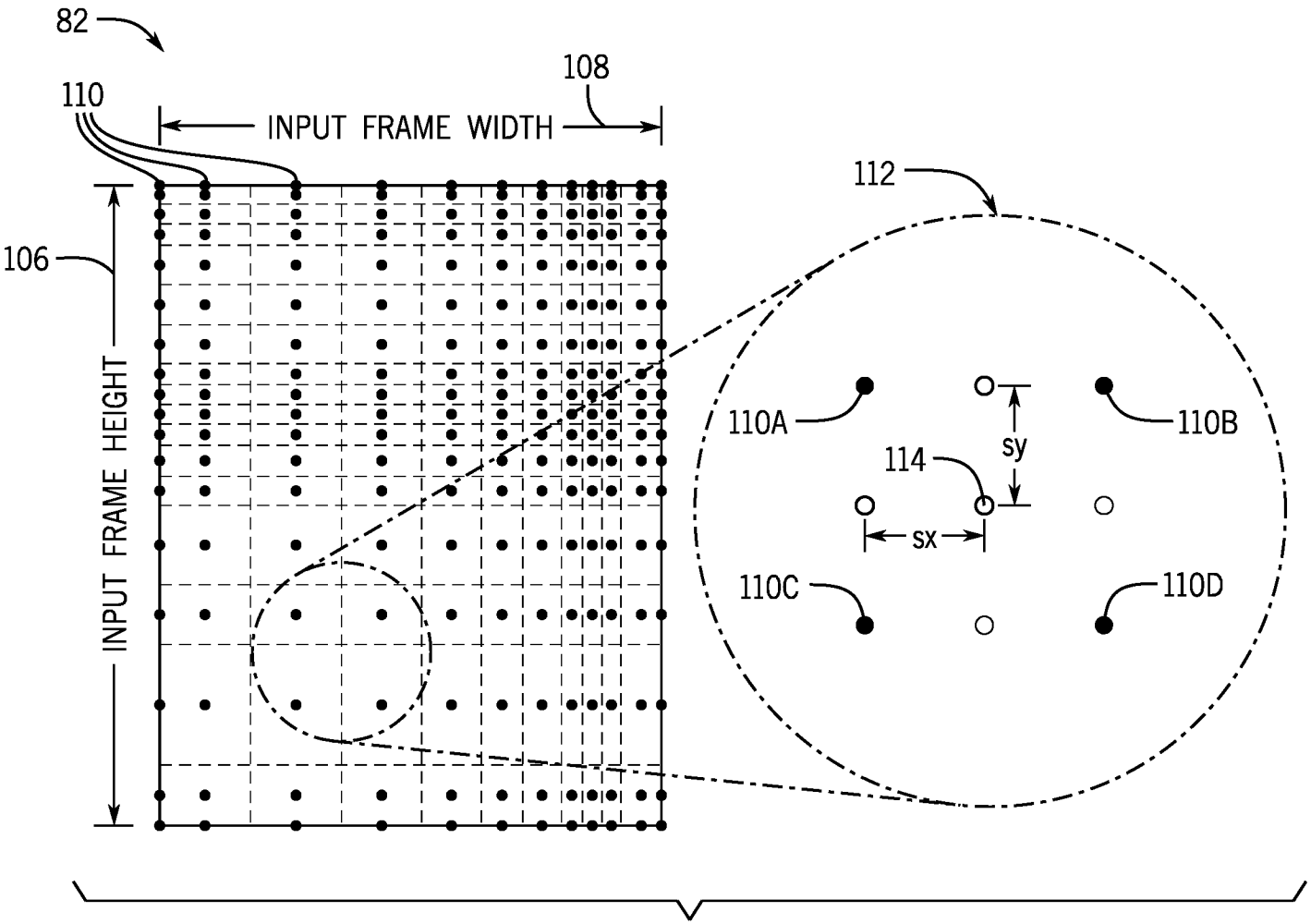
FIG. 11 is a schematic view of a lookup table (LUT) representing an example gain map derived from the collected burn-in statistics (BIS) and a manner of performing x2 spatial interpolation in both dimensions, in accordance with an embodiment.
Figure 12:
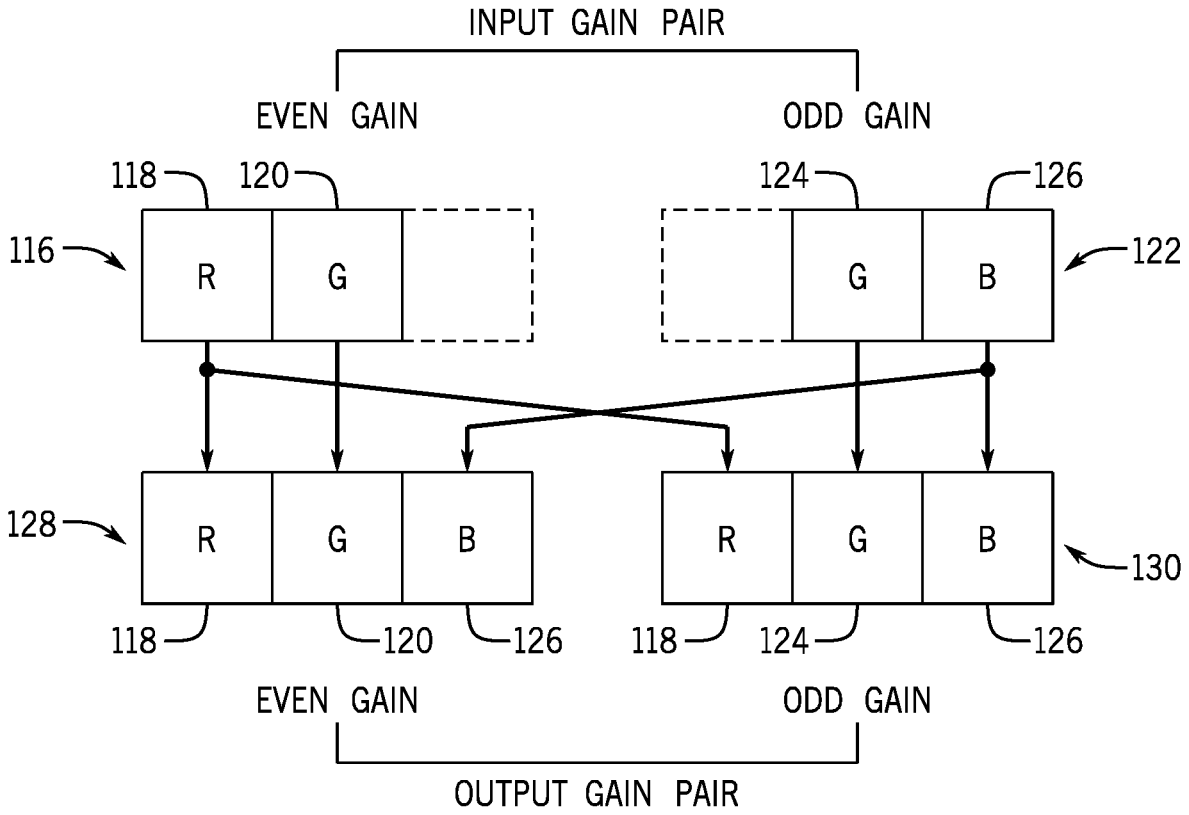
FIG. 12 is a diagram showing a manner of up-sampling two input pixel gain pairs into two output pixel gain pairs, in accordance with an embodiment.

FIGS. 11 and 12 describe the up-sampling block 88 to extract the per-component pixel gain value from the gain maps 82. The gain maps 82 may be full resolution per-sub-pixel two-dimensional (2D) gain maps or may be spatially downsampled, for example, to save memory and/or computational resources. When the dimensions of the gain maps 82 are less than the full resolution of the electronic display 12, the up-sampling block may up-sample the gain maps 82 to obtain the per-component pixel gain values discussed above. In some embodiments, the gain maps 82 may be stored as a multi-plane frame buffer. For example, when the electronic display 12 has three color components (e.g., red, green, and blue), the gain maps 82 may be stored as a 3-plane frame buffer. When the electronic display has some other number of color components (e.g., a 4-component display with red, green, blue, and white sub-pixels, or a 1-component monochrome display with only gray sub-pixels), the gain maps 82 may be stored with the corresponding number of planes.

Each plane of the gain maps 82 may be the full spatial resolution of the electronic display 12, or may be spatially downsampled by some factor (e.g., downsampled by some factor greater than 1, such as 1.5, 2, 3.5, 5, 7.5, 8, or more). Moreover, the amount of spatial downsampling may vary independently by dimension, and the dimensions of each of the planes of the gain maps 82 may differ. By way of example, a first color component (e.g., red) plane of the gain maps 82 may be spatially downsampled by a factor of 2 in both dimensions (e.g., in both x and y dimensions), a second color component (e.g., green) plane of the gain maps 82 may be spatially downsampled by a factor of 2 in one dimension (e.g., the x dimension) and downsampled by a factor of 4 in the other dimension (e.g., the y dimension), and a third color component (e.g., blue) plane of the gain maps 82 may be spatially downsampled by a factor of 4 in both dimensions (e.g., in both x and y dimensions). Further, in some examples, planes of the gain maps 82 may be downsampled to variable extents across the full resolution of the electronic display 12.

One example plane of the gain maps 82 appears in FIG. 11, and represents a downsampled mapping with variably reduced dimensions, and thus has been expanded to show the placement across a total input frame height 106 and an input frame width 108 of the electronic display 12 of the various gain values 110. Moreover, the plane of the gain maps 82 may have gain values 110 that are spaced unevenly, but as noted above, other planes of gain maps 82 may be spaced evenly.

Whether the gain values 110 are spaced evenly or unevenly across the x and y dimensions, the up-sampling block 88 may perform interpolation to obtain gain values for sub-pixels at (x, y) locations that are between the points of the gain values 110. Bilinear interpolation and nearest-neighbor interpolation methods will be discussed below. However, any suitable form of interpolation may be used.

In the example of FIG. 11, an interpolation region 112 of the plane of the gain maps 82 contains the four closest gain values 110A, 110B, 110C, and 110D to a current sub-pixel location 114 when the current interpolation region 112 the plane of the gain maps 82 has been downsampled by a factor 2 in both dimensions in this region. The size of the plane and/or of the interpolation region(s) of the gain maps 82 may be determined based on the active interpolation region, panel type, interpolation mode, phase and spatial sub-sampling factor for each color component and/or region.

The up-sampling block 88 may perform spatial interpolation of the fetched plane of the gain maps 82. Moreover, in some embodiments, a spatial shift of the plane of the gain maps 82, when down-sampled with respect to the pixel grid of the electronic display 12, may be supported through a configurable initial interpolation phase in each of the x and y dimensions (e.g., the initial value for sx and/or sy in FIG. 11). In some embodiments, when a plane or an interpolation region of the gain maps 82 is spatially down-sampled, sufficient gain value data points may be present for the subsequent up-sampling to happen without additional samples at the edges of the plane of the gain maps 82. As such, bilinear and/or nearest neighbor interpolation may be supported. Moreover, the up-sampling factor and interpolation method may be configurable separately for each of the color components.

In some cases, planes may be horizontally or vertically sub-sampled due to the panel layout. For example, some electronic displays 12 may support pixel groupings of less than every component of pixels, such as a GRGB panel with a pair of red and green and pair of blue and green pixels. In an example such as this, each red/blue component may be up-sampled by replication across a gain pair, as illustrated in FIG. 12. In the example of FIG. 12, an even gain pixel group 116 includes a red gain 118 and a green gain 120, and an odd gain pixel group 122 includes a green gain 124 and a blue gain 126. The output gain pair may thus include an even gain pixel group 128 that includes the red gain 118, the green gain 120, and the blue gain 126, and an odd gain pixel group 130 that includes the red gain 118, the green gain 120, and the blue gain 126.

Burn-in Statistics (BIS) Collection

As discussed above with reference to FIG. 8, the controller 42 or other software (e.g., an operating system, application program, or firmware of the electronic device 10) may use burn-in statistics (BIS) to generate the gain maps 82. The gain maps 82 are used to lower the maximum brightness for pixels that have not experienced as much aging, and, therefore, match other pixels that have experienced more aging. The gain maps 82 compensate for non-uniform aging effects and thereby aid in reducing or eliminating perceivable burn-in artifacts on the electronic display 12.

Figure 13:
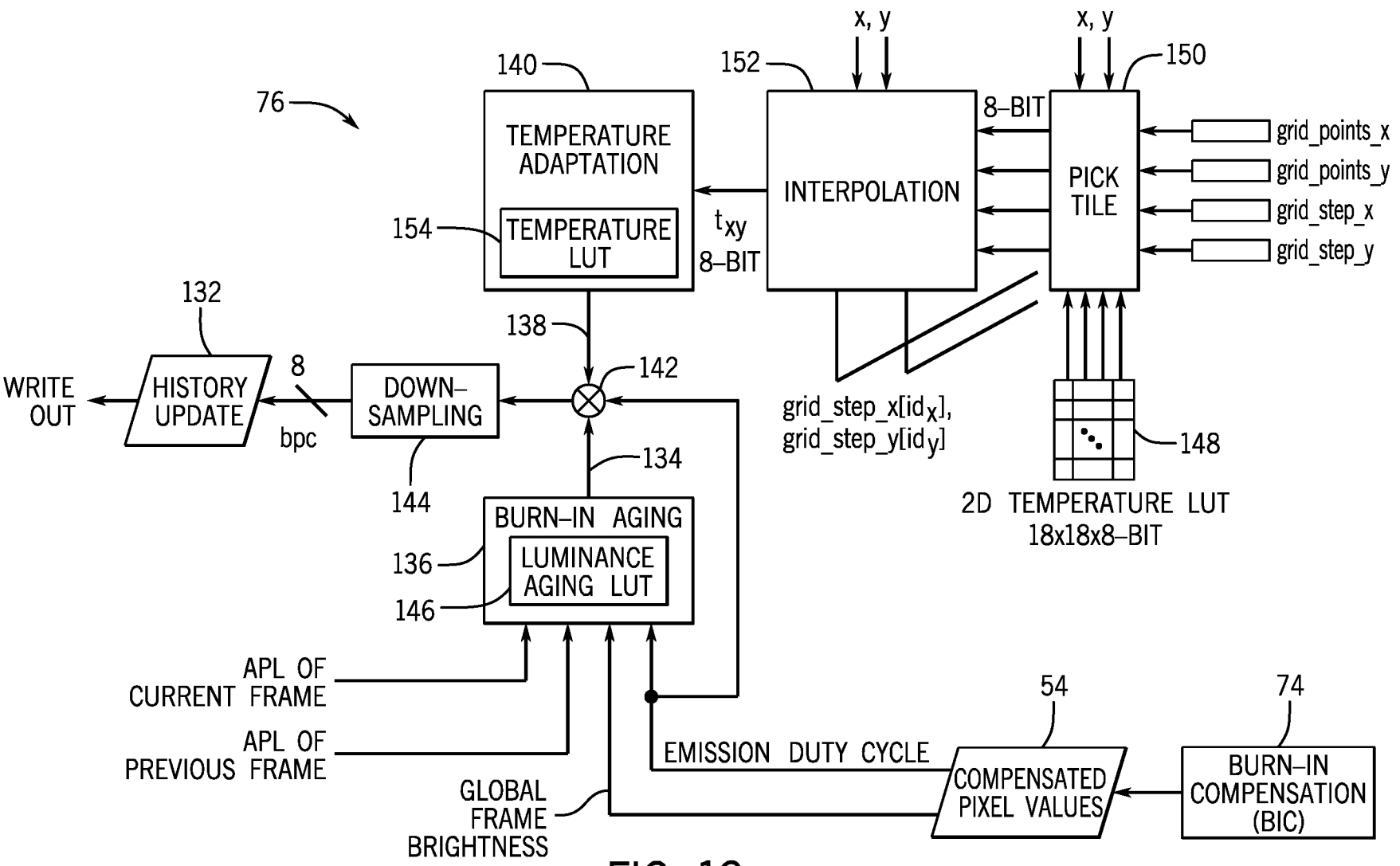
FIG. 13 is a block diagram showing burn-in statistics (BIS) collection that takes into account luminance aging and temperature adaptation, in accordance with an embodiment.

Furthermore, the total amount of luminance emitted by a pixel, as well as the environmental conditions (e.g., temperature) during emission, over its lifetime may have a substantial impact on the aging of that pixel. As such, the BIS collection processing 76 of the BIC/BIS block 50 may monitor and/or model a burn-in effect that would be likely to occur on the pixels of the electronic display 12 based on the image data sent to the electronic display 12 and/or the temperature of the electronic display 12. One or both of these factors (e.g., image data and temperature) may be considered by the BIS collection processing 76 in generating a BIS history update 132, as depicted in FIG. 13. The BIS history update 132 may be provided to the controller 42 or other data processing hardware or software to keep track of the usage history (e.g., history of luminance output) of the pixels and/or the environmental conditions of the pixel and to generate the gain maps 82 therefrom. In one embodiment, the BIS collection processing 76 may determine a luminance aging factor 134 from a burn-in aging block 136 or other computational structure and a temperature adaptation factor 138 from a temperature adaptation block 140 or other computational structure. The luminance aging factor 134 and the temperature adaptation factor 138 may be combined in a multiplier 142 and downsampled by a downsampling block 144 to generate the BIS history update 132. Additionally, although the BIS history update 132 is shown as having 8 bits per component (bpc), as should be appreciated, the BIS history update 132 may utilize any suitable bit depth.

The burn-in aging block 136 may combine multiple gain parameters 86 to estimate the impact of burn-in on the pixels and obtain the luminance aging factor 134. For example, the burn-in aging block 136 may determine the luminance aging factor 134 based on the compensated pixel values 54, the emission duty cycle, the global brightness, and/or a measure of the average pixel luminance (APL) of the current frame or previous frame. In one embodiment, the burn-in aging block 136 may determine the impact of the pixel gray level and the impact of the average pixel luminance and combine the two according to respective weights to determine the net burn-in impact.

Indeed, in one embodiment, the impact of the pixel gray level may be determined based on the agglomeration of the emission duty cycle, the global brightness of the display, the compensated pixel values 54 per color component, and/or one or more reference brightnesses. For example, the impact of the pixel gray level may be determined by scaling the compensated pixel values 54 by the global brightness normalized to a reference brightness and/or the inverse of the emission duty cycle. Furthermore, the impact of the pixel gray level may include an exponential factor that may vary per color component. As should be appreciated, the reference brightness, may be fixed or floating and, furthermore, may be based on the luminance output of the pixels. In one embodiment, the reference brightness may change between frames based on the emission duty cycle and the global brightness.

Furthermore, in one embodiment, the impact of the average pixel luminance may be determined based on the agglomeration of the emission duty cycle, the global brightness of the display, the compensated pixel values 54 per color component, a parameter characterizing the infrared (IR) drop of the display panel 40, the average pixel luminance of the current and/or previous frame, and/or a reference average pixel luminance. In some embodiments, the compensated pixel values 54 may be scaled by the APL. The scaling may be countered by the reference average pixel luminance and/or further scaled by the IR drop parameter, global brightness, and/or emission duty cycle and/or an inverse thereof. Furthermore, the impact of the pixel gray level may include one or more constant offsets and/or an exponential factor that may vary per color component. In some embodiments, it may be desirable to use the average pixel luminance of the previous frame, for example due to timings between computations. However, as should be appreciated, the APL of the current frame may also be used in computing the impact of the average pixel luminance on pixel aging.

In some embodiments, the net burn-in impact may be the product or addition of the impact of the pixel gray level and the impact of the average pixel luminance. As such, the net burn-in impact may be based on the compensated pixel values 54, the global brightness of the display panel 40, the emission duty cycle of the pixels, the average pixel luminance of the current frame, and/or the average pixel luminance of a previous frame. Furthermore, the net burn-in impact may be used to determine the luminance aging factor 134. For example, in some embodiments, the net burn-in impact may be fed into a luminance aging lookup table (LUT) 146. The luminance aging LUT 146 may be independent per color component and, as such, indexed by color component. Any suitable interpolation between the entries of the luminance aging LUT 146 may be used, such as linear interpolation between LUT entries. The luminance aging LUT 146 may output the luminance aging factor 134, which may be taken into account to model the amount of aging on each of the pixels and/or sub-pixels of the electronic display 12.

Non-uniform pixel aging may also be affected by the temperature of the electronic display 12 while the pixels of the electronic display 12 are emitting light. Indeed, temperature can vary across the electronic display 12 due to the presence of components such as the processor core complex 18 and other heat-producing circuits at various positions behind the electronic display 12.

Figure 14:
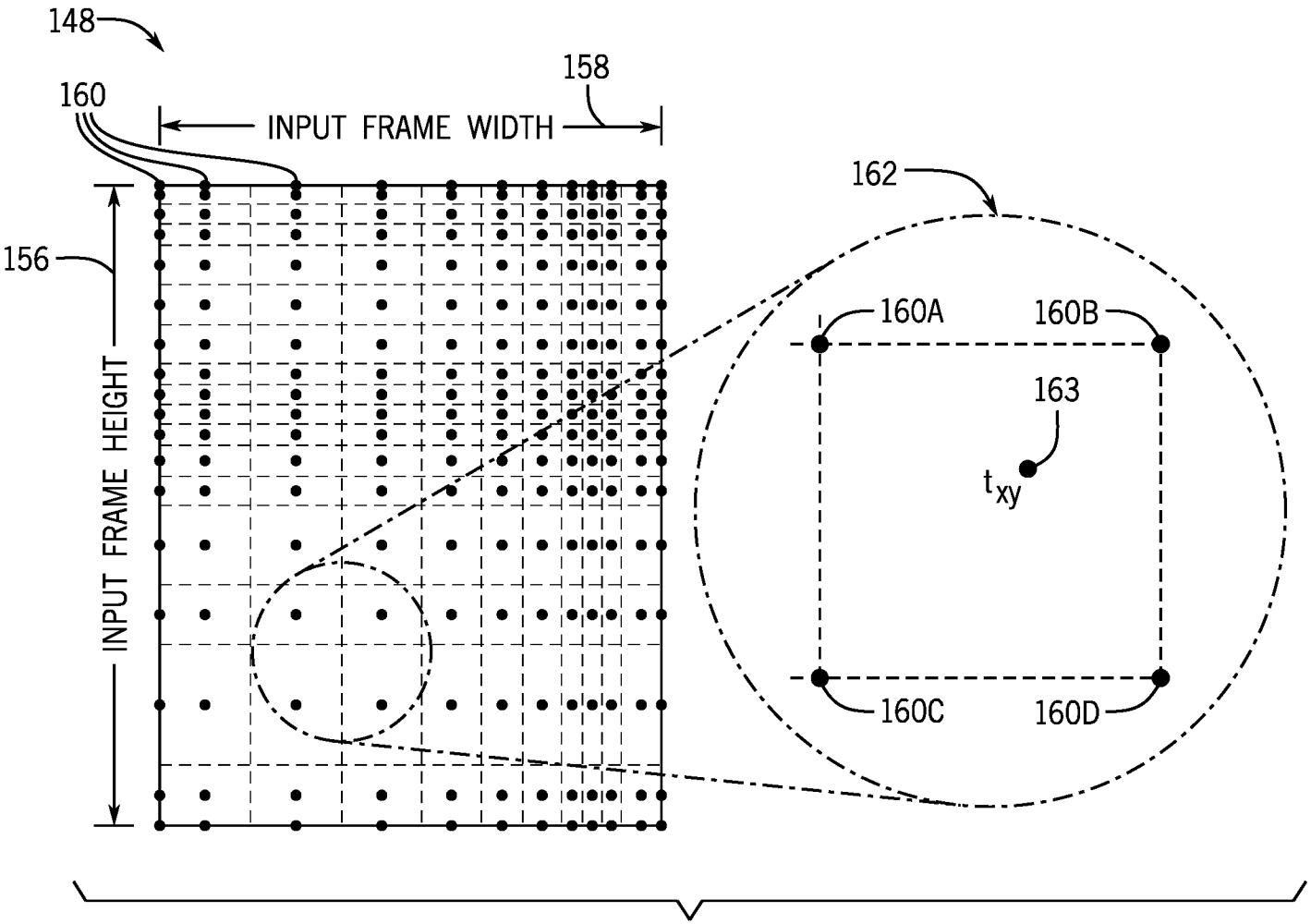
FIG. 14 is a schematic view of an example temperature map and a manner of performing bilinear interpolation to obtain a temperature value, in accordance with an embodiment.

To accurately determine an estimate of the local temperature on the electronic display 12, a two-dimensional (2D) grid of temperatures 148 may be used. An example of such a 2D grid of temperatures 148 is shown in FIG. 14 and will be discussed in greater detail below. Continuing with FIG. 13, a pick tile block 150 may select a particular region (e.g., tile) of the 2D grid of temperatures 148 from the (x, y) coordinates of the currently selected pixel. The pick tile block 150 may also use grid points in the x dimension (grid_points_x), grid points in the y dimension (grid_points_y), grid point steps in the x direction (grid_step_x), and grid point steps in the y direction (grid_step_y). These values may be adjusted, as discussed further below. A current pixel temperature value $t_{xy}$, may be selected from the resulting region of the 2D grid of temperatures 148 via an interpolation block 152, which may take into account the (x, y) coordinates of the currently selected sub-pixel and values of a grid step increment in the x dimension (grid_step_x [$id_x$]) and a grid step increment in the y dimension (grid_step_y[$id_y$]). The current pixel temperature value t, may be used by the temperature adaptation block 140 to produce the temperature adaptation factor 138, which indicates an amount of aging of the current pixel is likely to have occurred as a result of the current temperature of the current pixel. Additionally, in some embodiments, the current pixel temperature value $t_{xy}$ may be fed into a temperature lookup table (LUT) 154 to obtain the temperature adaptation factor 138.

An example of the two-dimensional (2D) grid of temperatures 148 appears in FIG. 14. The 2D grid of temperatures 148 illustrates the placement across a total input frame height 156 and an input frame width 158 of the electronic display 12 of the various current temperature grid values 160. The current temperature grid values 160 may be populated using any suitable measurement (e.g., temperature sensors) or modeling (e.g., an expected temperature value due to the current usage of various electronic components of the electronic device 10). An interpolation region 162 represents a region of the 2D grid of temperatures 148 that bounds a current spatial location (x, y) of a current pixel. A current pixel temperature value $t_{xy}$ may be found at an interpolated point 163. The interpolation may take place according to bilinear interpolation, nearest-neighbor interpolation, or any other suitable form of interpolation.

In one example, the two-dimensional (2D) grid of temperatures 148 may split the frame into separate regions (a region may be represented a rectangular area with a non-edge grid point at the center), or equivalently, 17×17 tiles (a tile may be represented as the rectangular area defined by four neighboring grid points, as shown in the interpolation region 162), is defined for the electronic display 12. Thus, the 2D grid of temperatures 148 may be determined according to any suitable experimentation or modeling for the electronic display 12. The 2D grid of temperatures 148 may be defined for an entirety of the electronic display 12, as opposed to just the current active region. This may allow the temperature estimation updates to run independently of the BIS/BIC updates. Moreover, the 2D grid of temperatures 148 may have uneven distributions of temperature grid values 160, allowing for higher resolution in areas of the electronic display 12 that are expected to have greater temperature variation (e.g., due to a larger number of distinct electronic components behind the electronic display 12 that could independently emit heat at different times due to variable use).

To accommodate for finer resolution at various positions, the 2D grid of temperatures 148 may be non-uniformly spaced. Two independent multi-entry 1D vectors (one for each dimension), grid_points_x and grid_points_y, are described in this disclosure to represent the temperature grid values 160. In the example of FIG. 14, there are 18 temperature grid values 160 in each dimension. However, any suitable number of temperature grid values 160 may be used. In addition, while these are shown to be equal in number in both dimensions, some 2D grids of temperatures 148 may have different numbers of temperature grid values 160 per dimension. The interpolation region 162 shows a rectangle of temperature grid values 160A, 160B, 160C, and 160D. The temperature grid values 160 may be represented in any suitable format, such as unsigned 8-bit, unsigned 9-bit, unsigned 10-bit, unsigned 11-bit, unsigned 12-bit, unsigned 13-bit, unsigned 14-bit, unsigned 15-bit, unsigned 16-bit, or the like. A value such as unsigned 13-bit notation may allow be implemented in a display panel 40 with a dimension of 8191 pixels.

Moreover, each tile (e.g., as shown in the interpolation region 162) may start at a temperature grid value 160 and may end one pixel prior to the next temperature grid value 160. Hence, for uniform handling in hardware, in some embodiments, at least one temperature grid value 160 (e.g., the last one) may be located a minimum of one pixel outside the frame dimension. Not all of the temperature grid values 160 may be used in all cases. For example, if a whole frame dimension of 512×512 is to be used as a single tile, grid_points_x[0] and grid_points_y[0] may each be programmed to 512. Spacing between successive temperature grid values 160 may include a minimum number of pixels (e.g., 8, 16, 24, 48, and so forth) and some maximum number of pixels (e.g., 512, 1024, 2048, 4096, and so forth). The temperature grid values 160 may have any suitable format.

Returning again to FIG. 13, the BIS history update 132 may involve the multiplication or other integration of the luminance aging factor 134 and the temperature adaptation factor 138 in conjunction with the emission duty cycle. For example, the multiplier 142 may combine the luminance aging factor and the temperature adaptation factor 138 and the emission duty cycle to generate a pre-downsampled history update. The downsampling block 144 may receive the pre-downsampled history update and generate the BIS history update 132. As discussed above, the BIS history update 132 may be of any suitable format.

Figure 15:
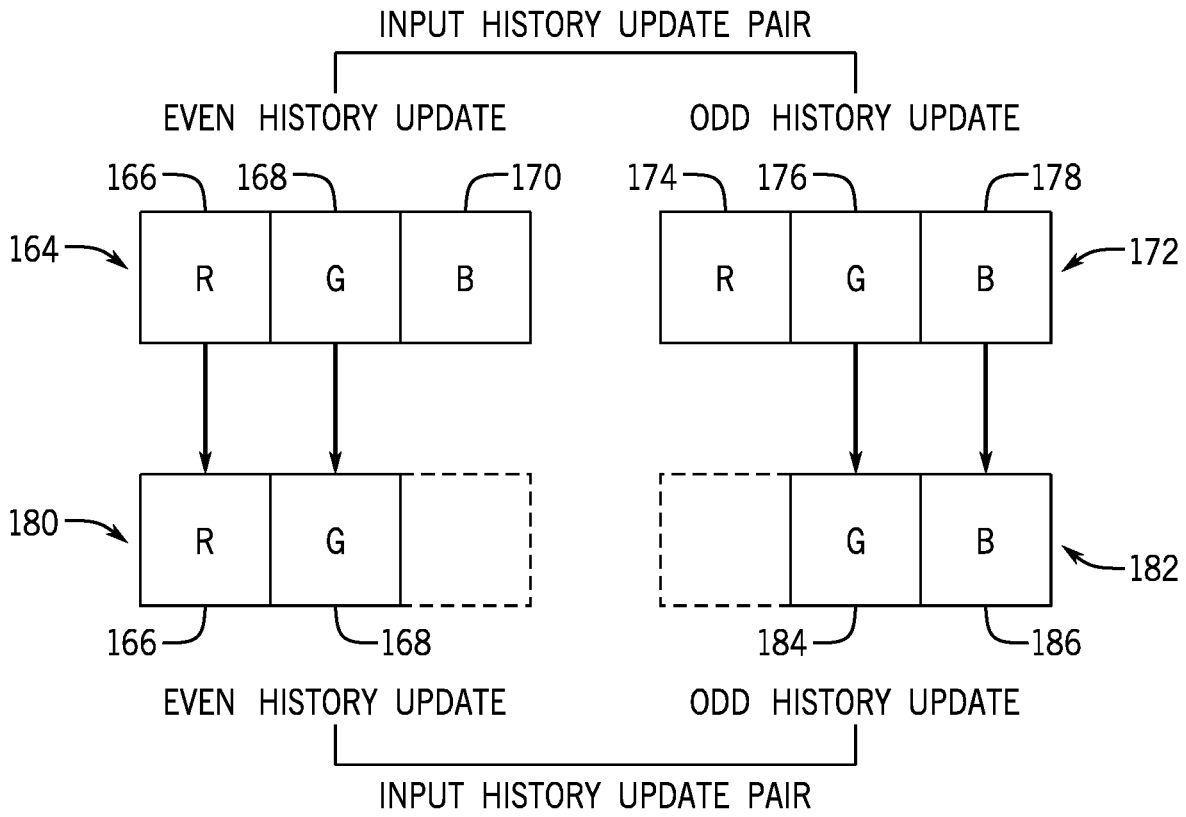
FIG. 15 is a diagram showing a manner of downsampling two input burn-in statistics (BIS) history pixel pairs into two output burn-in statistics (BIS) history pixel pairs, in accordance with an embodiment.

The downsampling block 144 may help reduce the throughput of and usage of resources (e.g., processor bandwidth, memory, etc.) involved in storing and/or utilizing the BIS history update 132. For example, the downsampling block may reduce the BIS history update 132 to an 8-bit string, or other suitable format of suitable bit-depth. In one embodiment, the BIS history update may be written out as three independent planes with the base addresses for each plane being byte aligned (e.g., 128-byte aligned). However, prior to write-out of the BIS history update 132 (e.g., updating the overall BIS with the BIS history update 132), the number of components per pixel may be down-sampled from 3 to 2, for example as illustrated in FIG. 15. Some electronic displays 12 may support pixel groupings of less than every component of pixels, such as a GRGB panel with a pair of red and green and pair of blue and green pixels. In an example such as this, each pair of pixels may have the red/blue components dropped to form a history update pair. In the example of FIG. 15, an even history update pixel group 164 includes a red history update value 166, a green history update value 168, and a blue history update value 170, and an odd history update pixel group 172 includes a red history update value 174, a green history update value 176, and a blue history update value 178. To down-sample this pair, the output history update pair may, thus, include an even history update pixel group 180 that includes the red history update value 166 and the green history update value 168, and an odd history update pixel group 182 that includes the green history update value 184 and the blue history update value 186.

Additionally or alternatively, in one embodiment, the BIS history update 132 may include a dynamic string format (e.g., 8-bits) to accurately represent a higher bit depth string (e.g., 10-bit, 12-bit, and so on). The dynamic string format may allow for the single string of bits to have multiple different meanings. For example, the dynamic string may represent different amounts of burn-in for a pixel depending on the emission duty cycle of the pixel during the frame. Moreover, in some embodiments, the information about the emission duty cycle of the pixel may be stored within the BIS history update 132, for example, as multiplied with the luminance aging factor and the temperature adaptation factor at the multiplier 142.

In some embodiments, the BIS history update 132 may be determined for each frame of input pixel values 52 sent to the display panel 40. In some implementations, however, it may not be practical to sample every frame. For example, resources such as electrical power, processing bandwidth, and/or memory allotment may vary depending on the electronic display 12. As such, in some embodiments, the BIS history update 132 may be determined periodically in time or by frame. For example, the BIS history update 132 may be determined at a rate of 1 Hz, 10 Hz, 60 Hz, 120 Hz, and so on. Additionally or alternatively, the BIS history update 132 may be determined once every other frame, every $10^{th}$ frame, every $60^{th}$ frame, every $120^{th}$ frame, etc. Furthermore, the write out rate of the BIS history update 132 may be dependent upon the refresh rate of the electronic display 12, which may also vary depending on the source image data 48. As such, the write out rate of the BIS history update 132 may be determined based on the bandwidth of the electronic device 10 or the electronic display 12, and may be reduced to accommodate the available processing bandwidth.

Figure 16:
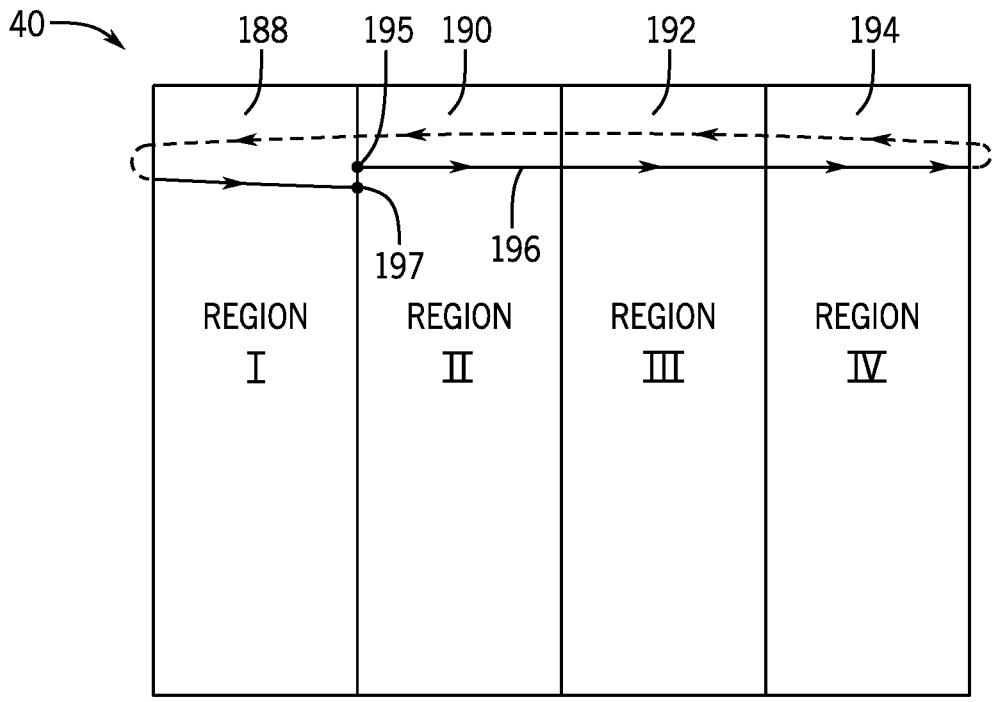
FIG. 16 is a diagram of a display panel divided into multiple regions for burn-in statistics collection, in accordance with an embodiment.

Additionally or alternatively, in some embodiments, BIS collection may be spread out over multiple frames by determining a BIS history update 132 for a portion of each frame. For example, FIG. 16 illustrates a display panel 40 divided into four regions. In one embodiment, a BIS history update 132 may be determined for a first region 188 during a first frame, a second region 190 during a second frame, a third region 192 during a third frame, and a fourth region 194 during a fourth frame. By spreading out the BIS history updates 132 over multiple frames, the write out of the BIS history update 132 may utilize a reduced amount of bandwidth (e.g., data processing or transfer over time). As such, the write out rate of the BIS history update 132 may be maintained or increased, while still remaining within the bandwidth capabilities of the electronic display 12. Furthermore, in some embodiments, the BIS history update 132 of each region may written out individually or be stored in a buffer until each region has been stored, and the entire buffer may be written out at once.

Moreover, in some embodiments, by spreading out the BIS history updates 132 over multiple frames and utilizing a reduced amount of bandwidth, a smaller amount of buffer memory may be used to write out the BIS history update 132. As such, the buffer size and/or the number of buffers used may be reduced. In one embodiment, a single buffer with a size corresponding to the size of the first region 188 may hold the BIS history update 132 for the pixels at pixel locations in the first region 188 during the first frame. Subsequently, the BIS history update 132 for the first region 188 may be written out (e.g., to memory) and the BIS history update 132 for the second region 190 may be held in the same memory buffer. As such, a single memory buffer may be reused for BIS history updates 132 for each region 188, 190, 192, 194 and have a size large enough to accommodate the BIS history update 132 for a single entire region. Additionally or alternatively, each region 188, 190, 192, 194 may have a separate buffer large enough for the corresponding region 188, 190, 192, 194.

As should be appreciated, the display panel 40 may be divided into any suitable number of regions. For example, the number of regions may be determined based on the size (e.g., width and/or height) of the display panel 40, a processing speed, and/or a desired bandwidth to remain within. The regions may also be of any suitable shape (e.g., rectangular, polygonal, etc.), and may be of approximately the same size or of different sizes. In one embodiment, the regions may be described as non-overlapping vertical stripes dividing the display panel 40.

The use of vertical regions may assist in processing efficiency, for example, in conjunction with the use of raster scan image data storage/transmission. In one embodiment, vertical regions may facilitate a stride 196 separating memory locations of the horizontal beginning of lines for a particular region (e.g., region 190). In other words, the stride 196 may allow memory locations of other regions (e.g., regions 188, 192, and 194) to be skipped to allow quick access of the region of interest (e.g., region 190). The stride 196 may correspond to the width of the regions and may assist in determining a BIS history update 132 for each region. For example, the pixel locations may be offset by a factor of the stride 196 to conveniently identify the pixels of a region of interest. For example, a first line of a region 190, beginning at a first memory location 195, may be accessed to determine a BIS history update 132. Subsequently, a second line of the region 190, beginning at a second memory location 197, may be accessed by adding the stride 196 to the first memory location 195 to continue determining the BIS history update 132 for the region 190 without cycling through memory locations of other regions (e.g., regions 188, 192, and 194). Such a process may be repeated for each region 188, 190, 192, and 194. The stride 196 may be of any suitable size (e.g., corresponding to the width of the regions), and, in some embodiments, may be byte aligned (e.g., 128-byte aligned). Furthermore, the stride 196 may be used to identify the buffer size to retain the BIS history update 132 for a region 188, 190, 192, 194. For example, the buffer size may be based on the stride 196 multiplied by the height of the frame (e.g., the pixel height of the display panel 40).

Figure 17:
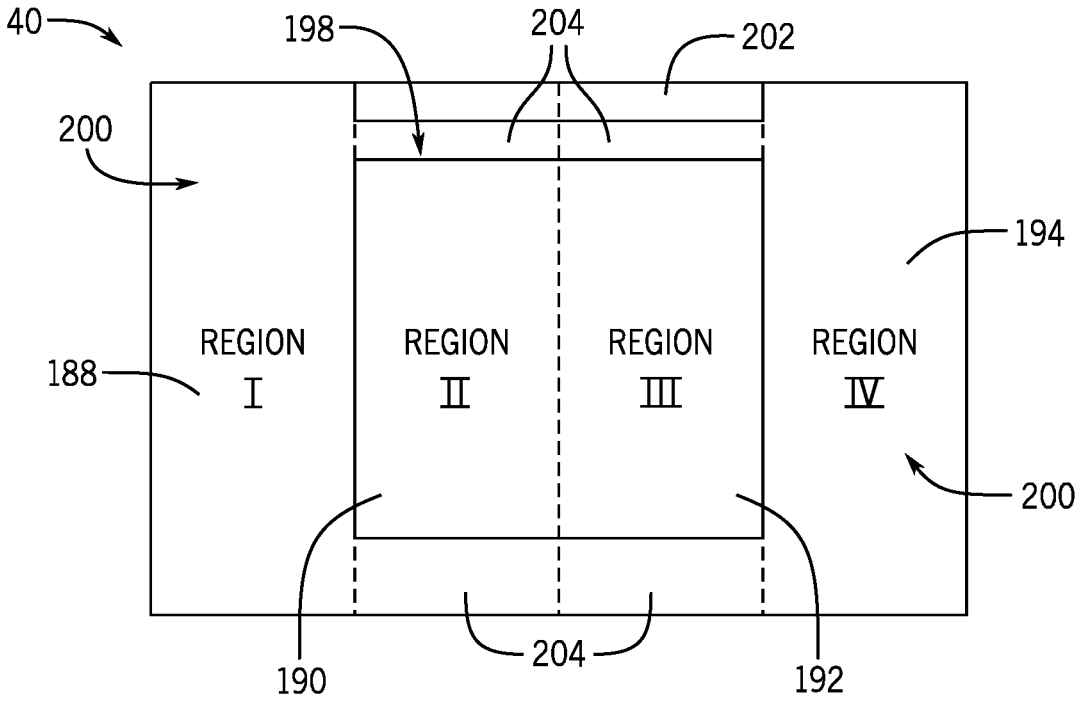
FIG. 17 is a diagram of a display panel divided into multiple regions for burn-in statistics collection of an active region, in accordance with an embodiment.

Additionally, dividing the display panel 40 into multiple regions may also assist in generating a BIS history update 132 for pixels in an active region 198 of the display panel 40, while ignoring pixels in a non-active region 200 (e.g., pixels that are effectively off and/or are desired to be excluded from a BIS history update 132), as illustrated in FIG. 17. In some scenarios, the source image data 48 may not contain input pixel values 52 for each pixel location of the display panel 40. For example, letterboxes or borders may be implemented as non-active regions 200 of the display panel 40 such that the pixels in the non-active regions 200 are off or given a defined value (e.g., a constant value or a value that forms part of a visual texture such as a gradient, which may allow the BIS to be determined based on the known defined value). Additionally, in some embodiments, the display panel 40 may have a notch 202. The notch 202 may be a portion of the display panel 40 without pixels, but may still be included in the pixel grid (e.g., having pixel coordinates corresponding to the input pixel values 52). As such, due to the constant and/or negligible aging of pixels in the non-active regions 200 or the lack of physical pixels in the notch 202, the BIS corresponding to pixels in the non-active region 200 or the notch 202 may be superfluous and, thus, not included in the BIS history update 132.

On the other hand, BIS corresponding to pixels in the active region 198 may be included into the BIS history update 132. Additionally, by using a stride 196 and dividing the display panel 40 into multiple regions, the active region 198 may be more flexibly identified and segmented such that the BIS history updates are more efficiently populated with BIS corresponding to pixels of the active region 198. As shown by example in FIG. 17, the display panel 40 may be divided into multiple regions such that the first region 188 and the fourth region 194 are non-active regions 200 and the second region 190 and the third region 192 are part of the active region 198. As such, the BIS history updates 132 may be more efficiently gathered based on pixels in the active region 198 while not gathering BIS for pixel values in non-active regions 200 or the notch 202. Furthermore, in some embodiments, portions 204 above or below the active region 198 and within the second region 190 and the third region 192 may be included or not included in the BIS history update 132 depending on implementation. Additionally or alternatively, the display panel 40 may be divided into multiple regions, and a BIS history update 132 may be generated for the regions that contain at least a portion of the active region 198 and no BIS may be calculated for regions that do not contain a portion of the active region 198.

Figure 18:
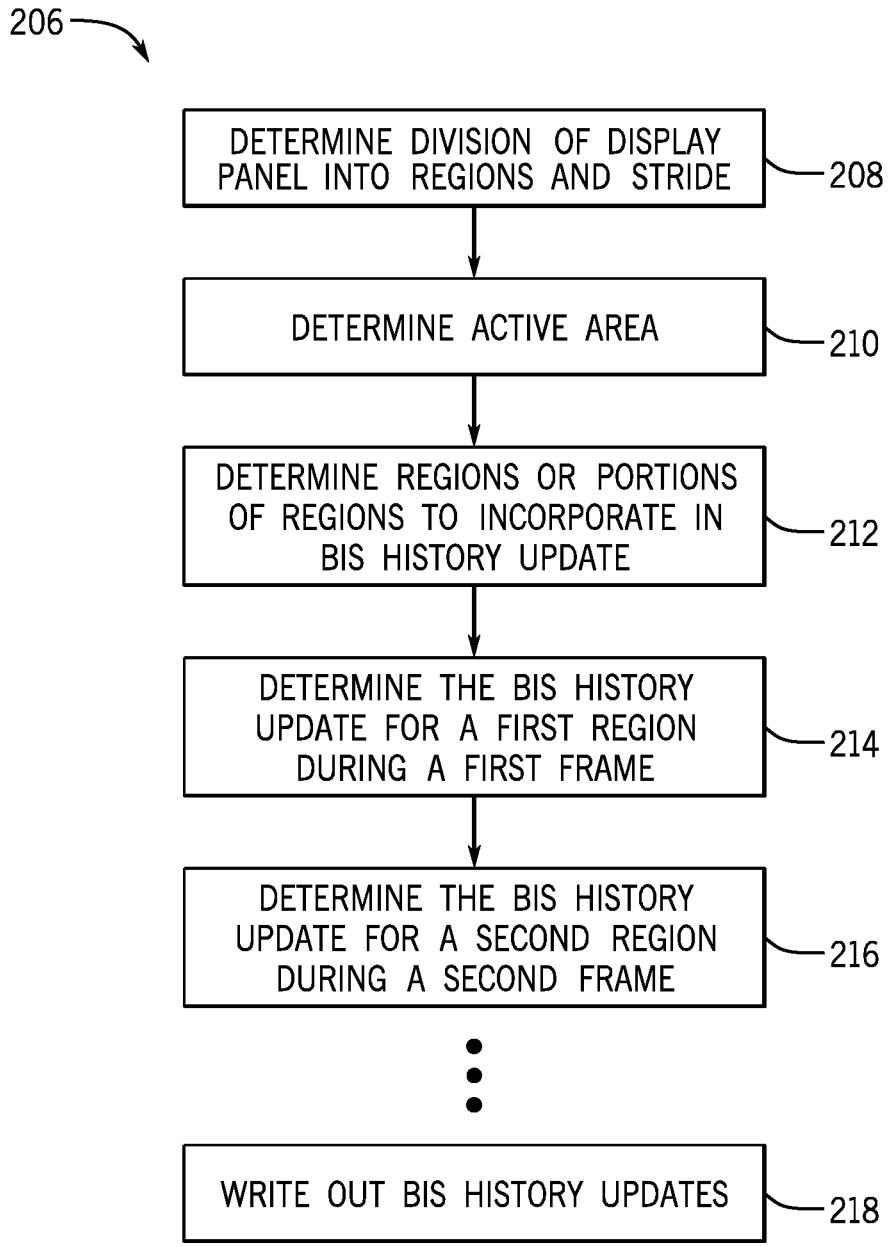
FIG. 18 is a flow diagram of an example process for collecting a burn-in statistics history update of a display panel divided into one or more regions, in accordance with an embodiment.

FIG. 18 is a flow diagram of an example process 206 for collecting BIS history updates 132 for the display panel 40 divided into one or more regions. The process 206 may include determining the division of the display panel 40 into multiple regions and determining the stride 196 associated with the division (process block 208). Additionally, in some embodiments, the active region 198 may be determined (process block 210). As should be appreciated, depending on implementation, the active region 198 may be determined before or after the division of the display panel 40 into regions. For example, the regions may be determined based in part on the active region 198. The regions or portions of regions to be incorporated into a BIS history update 132 may also be determined (process block 212). During a first frame, the BIS history update 132 for a first region (e.g., region 188, 190, 192, or 194) may be determined (process block 214). Additionally, during a second frame, subsequent to the first frame, the BIS history update 132 for a second region (e.g., region 188, 190, 192, or 194) may be determined (process block 216). The BIS history update 132 may also be determined for additional regions as desired. The regions may be processed for BIS in any desired order. In one embodiment, the regions incorporated into the BIS may be processed from left to right, relative to the display panel 40, for example by processing the first region 188, then the second region 190, then the third region 192, and so on. Furthermore, the frames in which each region's BIS history update 132 is determined may be immediately subsequent or may have frames in between. Once the BIS history update 132 for each desired region has been determined, the BIS history updates 132 may be written out (process block 218). As should be appreciated, the write out of the BIS history updates 132 may be done in bulk (e.g., for all of the entire regions) or individually (e.g., as the BIS history update 132 is determined for each region).

By compiling and storing the values of the BIS history update 132, the controller 42 or other software may determine a cumulative amount of non-uniform pixel aging across the electronic display 12. This may allow the gain maps 82 to be determined that may counteract the effects of the non-uniform pixel aging. By applying the gains of the gain maps 82 to the input pixels before they are provided to the electronic display 12, burn-in artifacts that might have otherwise appeared on the electronic display 12 may be reduced or eliminated in advance. Thereby, the burn-in compensation (BIC) and/or burn-in statistics (BIS) of this disclosure may provide a vastly improved user experience while efficiently using resources of the electronic device 10.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

an electronic display configured to display images during frames based on image data and divided into a plurality of regions, wherein each of the plurality of regions comprises a plurality of pixels; and a display pipeline configured to:

process the image data;

output the processed image data to the electronic display; and determine a history update corresponding to an estimated burn-in aging effect of the plurality of pixels based on usage, wherein a first portion of the history update corresponding to pixels in a first region of the plurality of regions is determined during a first frame and a second portion of the history update corresponding to pixels in a second region different from the first region of the plurality of regions is determined during a second frame subsequent to the first frame.

2. The electronic device of claim 1, wherein the plurality of regions are rectangular regions.

3. The electronic device of claim 1, wherein the plurality of regions are vertical stripes.

4. The electronic device of claim 1, wherein the display pipeline is configured to access memory locations of different lines of the first region by adding a stride to the memory locations such that a first memory location of a first beginning of a first line of the first region is accessed by adding the stride to a second memory location of a second beginning of a second line of the first region, wherein the first line is after the second line relative to a raster order.

5. The electronic device of claim 1, wherein the electronic display is divided into the plurality of regions based at least in part on a size of the electronic display.

6. The electronic device of claim 1, wherein the display pipeline is configured to determine an active area of the electronic display, wherein the history update is determined for a first set of pixels of the plurality of pixels within the active area and the history update is not determined for a second set of pixels of the plurality of pixels outside the active area.

7. The electronic device of claim 6, wherein the active area is divided among at least some of the plurality of regions.

8. The electronic device of claim 1, wherein the first portion of the history update for the first region of the plurality of regions is written out to memory separately from the second portion of the history update for the second region of the plurality of regions.

9. The electronic device of claim 1, wherein the first portion of the history update is determined once per second.

10. The electronic device of claim 1, comprising a buffer configured to hold the first portion of the history update and the second portion of the history update.

11. A system comprising:

a display panel comprising a plurality of pixels configured to display images in response to image data; and burn-in statistics collection circuitry coupled to the display panel and configured to determine burn-in aging for the plurality of pixels based on a plurality of incremental updates, wherein the burn-in statistics collection circuitry is configured to determine a first incremental update of the plurality of incremental updates corresponding to a first set of pixel locations of a first portion of pixels of the plurality of pixels and not a second set of pixel locations of a second portion of pixels of the plurality of pixels during a first frame and determine a second incremental update of the plurality of incremental updates corresponding to the second set of pixel locations of the second portion of pixels of the plurality of pixels during a second frame subsequent to the first frame.

12. The system of claim 11, wherein the second frame is immediately after the first frame.

13. The system of claim 11, wherein no incremental update is determined for a third set of pixel locations outside of an active region.

14. The system of claim 13, wherein the third set of pixel locations corresponds to a notch in the display panel where there are no pixels, to areas where pixels of the plurality of pixels are in an off state, or a combination thereof.

15. The system of claim 11, comprising burn-in compensation circuitry configured to change a luminance output of at least one pixel of the plurality of pixels based on the determined burn-in aging of the plurality of pixels to reduce a likelihood of perceivable burn-in effects during operation of the display panel.

16. The system of claim 11, wherein each incremental update of the plurality of incremental updates is determined once per second.

17. The system of claim 11, wherein the display panel is divided into at least two sets of pixel locations.

18. The system of claim 11, wherein the display panel comprises a self-emissive display panel.

19. A method comprising:

determining a plurality of regions of an electronic display configured to display a plurality of image frames based on image data;

determining a first burn-in statistics update for a first region but not a second region of the plurality of regions during a first frame;

determining a second burn-in statistics update for the second region of the plurality of regions during a second frame, wherein the second frame is subsequent to the first frame; and updating cumulative burn-in statistics by writing out the first burn-in statistics update and the second burn-in statistics update to memory.

20. The method of claim 19, comprising determining an active area of the electronic display, wherein the active area comprises at least a first portion of the first region and at least a second portion of the second region.

21. The method of claim 19, wherein the first burn-in statistics update is written out during the first frame and the second burn-in statistics update is written out during the second frame.

22. The method of claim 19, comprising determining a burn-in compensation for the image data based at least in part on the cumulative burn-in statistics.

* * * * *